US010323810B2

(12) United States Patent
Boldsen

(10) Patent No.: US 10,323,810 B2
(45) Date of Patent: Jun. 18, 2019

(54) ELECTRIC CANDLE AND ASSEMBLY THEREOF

(71) Applicant: SIRIUS COMPANY A/S, Allerød (DK)

(72) Inventor: Peter Christian Boldsen, Risskov (DK)

(73) Assignee: SIRIUS COMPANY A/S, Allerød (DK)

( * ) Notice: Subject to any disclaimer, the term of this patent is extended or adjusted under 35 U.S.C. 154(b) by 0 days.

(21) Appl. No.: 16/035,125

(22) Filed: Jul. 13, 2018

(65) Prior Publication Data

US 2019/0017669 A1 Jan. 17, 2019

(30) Foreign Application Priority Data

Jul. 14, 2017 (EP) ..... 17181470
Jan. 15, 2018 (WO) ..... PCT/EP2018/050839

(51) Int. Cl.

| | |
|---|---|
| ***F21S 6/00*** | (2006.01) |
| ***F21S 10/04*** | (2006.01) |
| *F21Y 115/10* | (2016.01) |
| *F21S 9/02* | (2006.01) |
| *F21W 121/00* | (2006.01) |

(52) U.S. Cl.

CPC ..... *F21S 10/046* (2013.01); *F21S 6/001* (2013.01); *F21S 9/02* (2013.01); *F21W 2121/00* (2013.01); *F21Y 2115/10* (2016.08)

(58) Field of Classification Search

CPC ..... F21S 6/001; F21S 10/04
See application file for complete search history.

(56) References Cited

U.S. PATENT DOCUMENTS

| | | | | |
|---|---|---|---|---|
| 9,541,247 | B2 | 1/2017 | Patton | |
| 2015/0276204 | A1* | 10/2015 | Ray | F21S 6/001 239/20 |
| 2015/0308643 | A1 | 10/2015 | Huang | |
| 2016/0153630 | A1 | 6/2016 | Dong | |
| 2016/0290579 | A1* | 10/2016 | Au | F21S 10/046 |

(Continued)

FOREIGN PATENT DOCUMENTS

| | | | |
|---|---|---|---|
| CN | 202791780 | U | 3/2013 |
| CN | 203298181 | U | 11/2013 |
| CN | 203431703 | U | 2/2014 |

(Continued)

OTHER PUBLICATIONS

International Search Report and Written Opinion, Appl. No. PCT/EP2018/050839, dated Jun. 1, 2018.

*Primary Examiner* — Evan P Dzierzynski
(74) *Attorney, Agent, or Firm* — Winston & Strawn LLP

(57) ABSTRACT

An electric candle comprising a housing with an upper opening, a support element with a support tip, a flame element that includes an upper flame portion extending out of the upper opening and an engagement recess for receiving the support tip in a manner wherein the flame element rests on top of the support element and the contact point between the support tip and the engagement recess defines an engagement point, an actuator for applying a force to the flame element, and a light source for emitting light on the upper flame portion, wherein the support tip, the engagement recess and the actuator are configured so that the force causes the flame element to simultaneously swing about the engagement point and rotate about the vertical axis through the engagement point.

24 Claims, 17 Drawing Sheets

(56) References Cited

U.S. PATENT DOCUMENTS

2016/0298816 A1 10/2016 Fang

FOREIGN PATENT DOCUMENTS

| | | | |
|---|---|---|---|
| CN | 204285290 | U | 4/2015 |
| CN | 204786143 | U | 11/2015 |
| EP | 3 001 100 | A1 | 3/2016 |
| WO | 2014/036968 | A1 | 3/2014 |

* cited by examiner

ELECTRIC CANDLE AND ASSEMBLY THEREOF

This application claims the benefit of International application no. PCT/EP2018/050839 filed Jan. 15, 2018 and European patent application no. 17181470.0 filed Jul. 14, 2017, the entire content of each of which is expressly incorporated herein by reference thereto.

BACKGROUND

The present invention relates to an electric candle with a moving flame element that visually simulates the flickering movements of a burning flame of a wax candle.

Electric candles are known, such as from U.S. Pat. No. 9,541,247 that describes an electric candle with a flame element being illuminated by a light source, and a drive mechanism that causes the flame element to move and thereby simulate a real burning flame. This and other patent documents describe flame elements with different shapes, different ways of suspending the flame element in relation to the housing and different drive mechanism, wherein the specific embodiments provide simulated flames that has different degrees of realism when compared to a burning flame.

The known electric candles are designed in a manner wherein especially the suspension of the flame element is complex, which means that assembly procedure of such candles are difficult and requires a huge number of steps, that the flame element may unintentionally be displaced from its intended position such as if the candle is turned upside down during transportation, and also that the candles have a high power consumption.

The flickering of a burning flame is the constant changes of the shape and orientation of the flame in a disordered and random manner, and is primarily caused by the constant movement of the bulk air surrounding the flame. A candle with a burning flame is often perceived as cozy, i.e., it provides a desired cozy atmosphere. Most of the parameters that cause the random and flickering movements of a burning flame does not influence the simulated flame of an electric candle. As an example, the natural movement of the surrounding bulk air does not affect the emitted light beam of an electric candle, and only causes the flame element (typically made of plastic) to move in an almost non-notable extent.

The extent of realism of an electric candle is primarily determined by the human perception of the movements of the flame element and the light emitted onto the flame element, which means that it is subjective whether one type of electric candle is perceived as more realistic than another type. However, an electric candle with a flame element that moves in a disordered and random manner is often perceived as having a higher extent of realism than a candle wherein the flame element that moves in an ordered manner.

It is therefore a main aspect of the present invention to provide an electric candle which will be perceived as more realistic than conventional electric candles.

SUMMARY OF THE INVENTION

It is an aspect of the present invention to provide an electric candle that is easy and cheap to assemble. It is another aspect of the present invention to provide an electric candle that has a robust construction. It is yet another aspect of the present invention to provide an electric candle that is energy efficient.

To achieve these aspects, the electric candle of the present invention comprises:

a housing with an upper opening, a support element with a support tip, a flame element comprising an upper flame portion extending out of said upper opening and an engagement recess for receiving said support tip in a manner wherein the flame element rests on top of the support element, and wherein the contact point between the support tip and the engagement recess in the resting position of the flame element defines an engagement point, an actuator for applying a force to the flame element, and a light source for emitting light on the upper flame portion, wherein the support tip, the engagement recess and the actuator are configured so that said force causes the flame element to simultaneously swing about said engagement point and rotate about the vertical axis through said engagement point.

It is to be understood that the flame element is suspended freely on the support element, i.e., suspended in a manner using no wire etc. to attach the flame element to the support element or the housing.

The invention also relates to a method of assembling the electric candles disclosed herein. This method comprises the steps of:

providing the flame element with an upper flame portion that is a substantially flat member, providing the housing in the form of a cover and a main body with an upper opening and a lower opening, wherein the upper opening is a substantially elongated opening with a substantially circular part, wherein the maximum width of the flat upper flame portion is larger than the diameter of the circular part but shorter than the longitudinal length of the upper opening, attaching the support element, actuator and light source to the cover using appropriate attachment means, lowering the flame element down onto the support tip of the support element, bringing the main body and the cover towards each other until the upper flame portion extends out of the upper opening and while the main body and the cover are orientated so that the flame element is centered in and orientated along the longitudinal length of the upper opening, rotating the main body and/or the cover about the vertical axis through the engagement point until the flat upper flame portion extends in the transverse direction of the upper opening, and moving the main body and/or the cover until the flame element is centered in the central part of the upper opening, bringing the main body and the cover further towards each other until the cover closes off the lower opening of the main body, and attaching the main body to the cover using appropriate attachment means.

BRIEF DESCRIPTION OF THE DRAWINGS

The invention will be explained in greater detail herein where further advantageous features and functions and example embodiments are described with reference to the drawings, in which.

DETAILED DESCRIPTION

Figure 1:
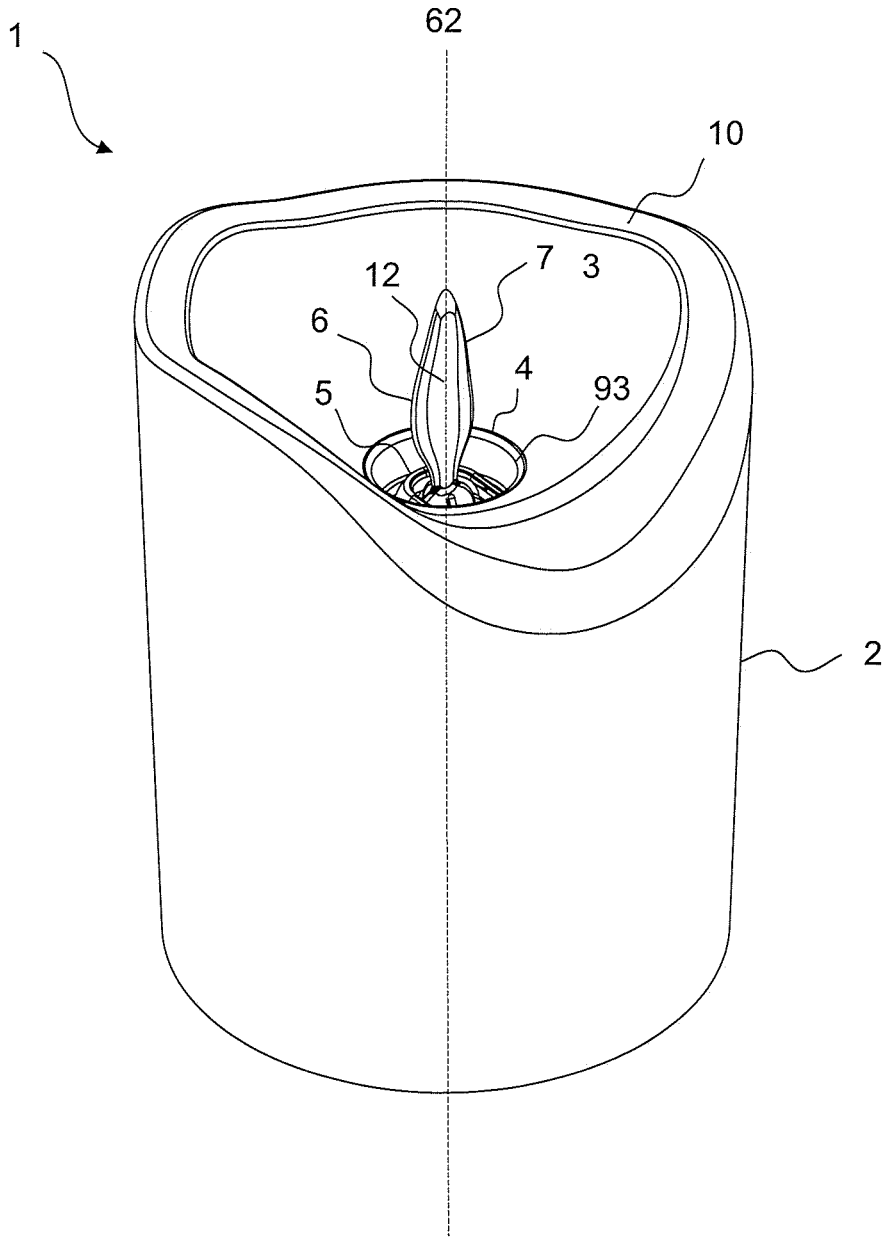
FIG. 1 is shows a first embodiment of the present invention with an inner housing and outer housing.

Within the context of the present invention, the term "engagement point" is defined as the point of contact between the support tip and the engagement recess, or more precisely as the center of the contact area between the support tip and the engagement recess, when the flame element is at rest on top of the support element. In order to obtain a stable movement of the flame element, the mass center of the flame element is preferably below the engagement point.

Unless stated otherwise, the terms "swing", "swinging", "rotate" and "rotation" of the flame element is in relation to the support element in a use position of the candle according to the invention where the candle is placed horizontally such as on a flat horizontal surface.

The support element, actuator and light source are preferably mounted in the housing and preferably surrounded by the housing. The flame element is arranged so that its upper flame portion at least partly extends out of the housing through its upper opening. The light source is preferably located well inside the housing so that a person does not see the light source when standing next to the candle, and the light source is preferably an LED.

The electric candle also comprises a control system (preferably a printed circuit board), a power source (preferably one or more batteries) and preferably a switch for turning the power on/off, where the control system controls the actuator and the light source, and the power source provides electricity to the actuator, light source and the control system. The control system, power source, switch, actuator and light source are electrically connected by means of appropriate electrical wirings.

As the flame element of the present invention rests on top of the support element, the assembly of the electric candle may comprise that the flame element simply is lowered down onto the support element, which means that the assembly is simpler and thus cheaper than if the flame element had to be fixed to a support element or if the flame element e.g. were provided with a through-going hole through which a supporting wire or similar had to be inserted. It is thus preferred that the assembly of the electric candle does not comprise that the flame element is fixed to the support element.

It is preferred that the extent of swinging, the extent of rotation, and the direction of rotation of the flame element of the present invention vary over time, which can be obtained in that the actuator is arranged for being alternating active and inactive, where the actuator only applies a force to the flame element when it is active.

In periods where the actuator is inactive, the extent of the swinging/rotational movements started during the preceding activation time period will gradually decrease.

The actuator is preferably continuously activated and inactivated in a manner where each activation is initiated before the flame element has had time to come to rest during the preceding deactivation time period, so that the flame element continuously swing and rotate.

Most preferably, the duration of such successive activations of the actuator varies and/or the durations of the successive deactivations of the actuator varies so that the resulting simultaneous swinging and rotational movements of the flame element will be disordered and somewhat chaotic and thereby provide the intended simulation of a candle with a burning flame.

The support element and the engagement recess are preferably configured so that the flame element has a resting position with a specific position and specific orientation in relation to the support element. Thus, in a use position of the candle where the candle is placed horizontally and the flame element after swinging and/or rotational movements comes to rest, the flame element will not only always return to substantially the same specific position in relation to the support element but also return to substantially the same specific orientation in relation to the support element.

The upper flame portion of a flame element in its resting position will, when the applied force from the actuator is kept appropriate low so that especially the extent of rotation of the flame element is also kept appropriate low (such as a rotation of less than ±15° in relation to the resting position of the flame element), face in substantially the same direction during use of the candle. Thus by keeping the applied force appropriate low, the light projected onto the upper flame element will only hit a limited surface area of the upper flame portion, where this limited surface area advantageously can be shaped and dimensioned to enhance the perceived realism of the electric candle.

The upper flame portion is preferably a substantially flat member, in which case it is especially important that the flame element is orientated in substantially the same direction when it swings/rotates during use of the candle, as it is desirable that one of the two opposing main surfaces of such a flat member during use is more or less facing in the direction of the emitted light from the light source so that as much light as possible hits that main surface rather than passes by the upper flame portion, so that the extent to which the upper flame portion is lit up during the swinging/rotational movements is increased.

It is preferred that the support tip and the engagement recess are configured so that the flame element ascend in relation to the support tip when the rotational movement of the flame element is in a direction from its resting position towards a first position, and descend when the rotational movement is in a direction from the first position towards the resting position.

Thus, when the flame element, due to the force applied by the actuator, is rotated away from its resting position, either in the clockwise or counterclockwise direction, the support tip and the engagement recess are shaped so that the flame element ascend in the vertical direction compared to its resting position. As such an elevated position is associated with an increase in the potential energy of the flame element, this also means that when the actuator subsequently is inactive, gravity has the effect that the flame element will descend vertically towards its resting position and thereby rotate back towards the specific orientation it has in its resting position.

The above-mentioned increase in potential energy is caused merely by the rotation of the flame element away from the orientation it has in its resting position. In the resting position of the flame element, the mass center of the flame element is below the engagement point, which means that a mere swinging movement of the flame element from its resting position also increases the potential energy as the mass center moves upwards.

The exact position of the flame element in the above-mentioned "first position" depends on a number of parameters, such as the specific shape of the support tip and the engagement recess as well as the strength of the force applied by the actuator.

Preferably, the strength of the force applied by the actuator and/or the ratio of activation time versus deactivation time of the actuator are adapted so that the flame element only rotates away from its resting position to a minor extent, which e.g. can be an angular rotation of ±20°, ±10°, or in the interval from ±20° to ±10°. One effect of having a limited angular rotation is that the flame element is mainly facing in the same direction during use, which means that the light projected on the upper flame portion will substantially only hit the surface area of the upper flame portion that is being hit when the flame element is in its resting position and the immediate surrounding surface area thereof.

In order to ensure that the angular rotation of the flame element is kept within a certain extent of rotation, e.g. ±15°, the strength of the force applied by the actuator is kept below a certain threshold, where the threshold depends on a number of parameters such as the shape/dimensions/materials of the support tip and the engagement recess, as well as the weight and weight distribution of the flame element. A person skilled in the art will understand how to arrange the actuator, flame element and support tip in order for the applied force to limit the extent of rotation of the flame element to be below a certain threshold.

The engagement recess and the support tip are even more preferably configured so that the more the flame element is rotated in the direction from its resting position towards said first position the more the flame element is elevated. One effect thereof is that the extent of angular rotation of the flame element can be limited just by limiting the strength of the applied force from the actuator, as increased elevation requires an applied force with higher strength. Another effect is that gravity ensures that the flame element returns to its resting position when the actuator is inactive.

With the present invention it is not necessary to have a separate means for limiting the angular rotation, as this limitation can be inherent in the form (shape and dimensions) of the support tip and the support recess.

The engagement recess and the support tip can be shaped and dimensioned in a number of ways that elevates the flame element when it is rotated from its resting position towards the above-mentioned first position, such as when the support tip comprises a substantially flat first portion that is orientated vertically and has a substantially U-shaped cut-out facing upwards (in a use position of the candle where the candle is placed horizontally), and the flame element comprises a substantially flat second portion that is orientated vertically and has a substantially U-shaped cut-out facing downwards (in a use position of the candle where the candle is placed horizontally), where the cut-out of the flame element defines the engagement recess of the flame element.

In the context of the present invention, the term "U-shaped cut-out" is defined as a through-going cut-out formed by two diverging sides that meet at the bottom of the cut-out, unless stated otherwise.

The cut-outs are arranged so that the cut-out of the flame element receives the cut-out of the support tip in a manner where the flame element rests on top of the support element, and the angle between the first portion and the second portion is substantially 90° when the flame element is in its resting position. In the resting position of the flame element, the bottom of the two U-shaped cut-outs will contact each other, and this point of contact is the engagement point.

The effect of having cut-outs with sides that are diverging upwards from the bottom is that the more the flame element is rotated in the direction from its resting position towards the first position the more the flame element ascend in the horizontal direction. Thus, the shape of the cut-outs not only limits the extent of rotation but also guides the rotation of the flame element.

As the cut-outs are U-shaped, the flame element becomes elevated in relation to the support element when the flame element is rotated away from its resting position, either in the clockwise or counterclockwise direction. This means that the extent of angular rotation and thus the extent of elevation of the flame element is restricted by the strength of the applied force from the actuator as well as the shape/dimensions of the cut-outs.

It is also preferred that the diverging sides and the bottom of each cut-out are rounded in the transverse direction in order to further reduce the friction between the support tip and the engagement recess during the combined swinging and rotational movements of the flame element, which reduced the power consumption. Another effect of using such U-shaped cut-outs is that the swinging/rotational movements of the flame element are smooth movements.

Each U-shaped cut-out is preferably symmetric about a vertical axis through its bottom so that the strength of the applied force needed to rotate the flame element from its resting position is the same whether the rotation is in the clockwise or counterclockwise direction. It is most preferred that each cut-out in addition to being symmetric, are shaped so that at least the main part of each diverging side is straight.

The light source and the substantially flat first portion of the support tip are preferably arranged so that an appropriate part of the flat first portion comes between the emitted light from the light source and the upper flame portion in order to produce a small oblong shadow at the very bottom of the upper flame portion, where the shadow is shaped/dimensioned to look like the dark wick of a real burning flame in order to enhance the simulation of a real burning flame.

The angular rotation of the flame element about the vertical axis through the engagement point can further be restricted by providing the flat second portion of the flame element with two substantially horizontally extending projections, which are arranged so that one of the projections will hit the flat first portion of the support tip when the flame element is rotated in one angular direction, and the other projection will hit the flat first portion of the support tip when the flame element is rotated in the opposite angular direction.

The projections can e.g. be arranged so that the rotation of the flame element is limited to a maximum angular rotation of between ±20° and ±10°, such as e.g. ±20°, ±15° or ±10°, or most preferred ±13° in relation to the resting position of the flame element.

The two projections may be provided on the same vertical outer surface of the first portion, and preferably symmetric about the vertical axis through the bottom of the U-shaped cut-out.

When the assembled electric candle e.g. during transport from the factory is subjected to bumps, being turned upside down or similar movements, the restrictions on the movements of the flame element due to the above-mentioned projections are especially helpful in insuring that the flame element maintains its position on top of the support element.

The force applied by the actuator can be adapted to intentionally rotate the flame element so much that the rotation is stopped by the projections, so that an abrupt change in movements of the flame element is obtained. Such an abrupt change in the rotation of the flame element causes the overall movement of the flame element to be more chaotic, and thereby increases the realism of the simulated flame.

Instead of having a support tip comprising a flat first portion with a cut-out and a flame element comprising a flat second portion with a cut-out, the support tip may be a support rod with a top shaped as a semicircular arch, and the flame element may comprise a substantially spherical portion with a downwards facing engagement recess, where the shape/dimensions of the engagement recess matches the shape/dimensions of the top of the support rod, and where the support tip and the engagement recess are arranged so that flame element ascend when rotated in the direction from its resting position towards a first position and descend when rotated in the direction from the first position toward the resting position.

For the embodiments of the present invention where the support tip comprises a substantially flat first portion with a U-shaped cut-out and the flame element comprises a substantially flat second portion with a U-shaped cut-out, the vertical plane in which the flat second portion lies when the flame element is in its resting position defines a first vertical plane, and the actuator is advantageously configured so that the direction of the force applied by the actuator on the flame element, when the flame element is in its resting position, is in a second vertical plane that goes through the engagement point and is non-parallel with said first vertical plane. The actuator may also be arranged so that the direction of said force is in a second vertical plane that is non-parallel with said first vertical plane but does not go through the engagement point.

The angle between the first vertical plane and the second vertical plane is preferably between 5° and 20°, most preferably about 10°.

As the first vertical plane and the second vertical plane are non-parallel, such an applied force will, when the flame element is at rest, force the flame element to simultaneously swing and rotate in relation to the support element, where the rotation is in the direction from the second vertical plane toward the first vertical plane.

It is important to notice that although such an applied force gives the flame element a "push", it is the shape/dimensions of the support tip and the engagement recess that transform the movement initiated by the push into a combined swinging and rotational movement of the flame element.

With the present invention it is not necessary to have one actuator causing the swinging movement and another actuator causing the rotational movement, in order to obtain a disordered movement of the flame element. As the flame element rest freely on top of the support tip, it is sufficient to use single actuator where the only other force that acts on the flame element is gravity, and still obtain a combined swinging/rotational movement of the flame element.

The purpose of the actuator of the present invention is to initiate a swinging and rotational movement of the flame element, and various types of actuators accomplish this purpose. The actuator preferably comprises at least one magnet and an electromagnetic coil as this gives a simpler and more reliable construction of the electric candle compared to other types of actuators.

The strength of the applied force depends on the mutual positioning of the electromagnet and the magnet(s). The electromagnet is preferably fixed to the housing, which means that the flame element can be the only moving component of the electric candle. As few moving components as possible is advantageous in order to reduce power consumption, and in order to obtain a robust and fail-safe construction of the electric candle.

It is however preferred that the actuator comprises at least one magnet fixed to the flame element, and an electromagnetic coil arranged below the at least one magnet and concentric about the vertical axis through the engagement point, where the at least one magnet is arranged so that the vertical plane through the center of the magnet and the engagement point is non-parallel with the first vertical plane through the flat first portion of the support tip, and where each of the at least one magnet is arranged so that its north pole is closer to the center of the electromagnet coil than its south pole, or vice versa.

This means that the electromagnetic field generated by the electromagnetic coil is symmetric about the vertical axis through the engagement point, and that the electromagnet field from the coil is stronger at one end of each magnet than at the other end of that magnet. When each magnet at the same time is positioned so that its center is offset the first vertical plane through the support tip, the electromagnetic force will, when the flame element is in its resting position, initiate a rotation of the flame element, where the direction of the current through the coil determines whether the initiated rotation is in the clockwise or counterclockwise direction.

It is moreover preferred that each of the at least one magnet is arranged so that its longitudinal axis is perpendicular to the first vertical plane through the flat second portion of the flame element. This is especially advantageous when the flame element is manufactured using injection moulding, because the flame element may be provided with one cylindrical cavity for each of the magnets, where the longitudinal axis of each cavity is perpendicular to the first vertical plane through the flat second portion of the flame element.

It is most preferred that the actuator comprises two magnets arranged on the flame element so that they in the resting position of the flame element are located on opposite sides of the flat first portion of the support tip, where the vertical plane through the center of both of the two magnets and the engagement point defines a second vertical plane that is non-parallel with the first vertical plane through the flat first portion of the support tip, and where the center of both of the magnets are in the same horizontal plane and at the same distance from the engagement point. The effect of having a flame element with two magnets arranged in this manner and an electromagnet being symmetric about the vertical axis through the engagement point is that the strength of electromagnetic force applied to each of the two magnets, when the flame element is in its resting position, is the same, which means the strength of the applied force needed to rotate the flame element from its resting position in either the clockwise or counterclockwise direction is the same.

In another embodiment, the actuator comprises an electromagnetic coil that is non-concentric about the vertical axis through the engagement point and one or more magnets, most preferably two magnets, where the coil and the one or more magnets are arranged so that the direction of the force applied by the actuator on the flame element is in a second vertical plane that is non-parallel with the first vertical plane through the flame element. In this embodiment, the electromagnetic field generated by the electromagnetic coil is not symmetric about the vertical axis through the engagement point.

When the actuator is at least one magnet and an electromagnet, it is not only the activation of the movements of the flame element that can be obtained without any physical contact between the flame element and the other components of the electric candle (except the necessary contact with the support tip due to the suspension of the flame element), it is also the limitation of the rotational movement of the flame element that can be caused without any such contact by controlling the force applied by the electromagnet. The effect of this very limited physical contact is that the electric candle is very energy efficient, due to the low friction force between the components of the electric candle.

As described above, there are different ways of configuring the support element, flame element and electromagnet so that the direction of the force is in a second vertical plane that is non-parallel with the first vertical plane, and there are also different ways of configuring the support tip and the engagement recess so that the initiated movement of the flame element is transformed into a combined swinging and rotational movement.

The flame element needs space inside the housing in order to be able to swing back and forth without touching the inner surface of the housing. The part of the flame element that is located inside the housing and, due to the swinging movements of the flame element, moves furthest away from the vertical axis through the engagement point is the lowermost portion of the flame element.

By appropriately arranging the electromagnetic coil below the magnet(s) in the resting position of the flame element and at the same time straight below the engagement point, it is the flame element and not the electromagnetic coil that limits the minimum required radial distance between the vertical axis through the engagement point and the inner surface of the housing. With this configuration, the electric candle according to the present invention may have the same shape and dimensions of a crown candle with a diameter as small as about 2 cm. In addition, it is not only possible to have a relative small distance (such as less than 3 mm, and most preferably about 1 mm) between the electromagnet and the magnet(s) in the resting position of the flame element, but the distance between the electromagnet and the magnet (s) is also substantially constant during the movements of the flame element, which is advantageous as the power consumption required to apply a certain electromagnetic force to a magnet decreases when the distance between the magnet and electromagnet decreases. Thus a more energy efficient arrangement is provided.

Another effect of providing the at least one magnet at the lowermost portion(s) of the flame element is that the mass center of the flame element is as far as possible below the engagement point.

In order to have an electromagnet field that is symmetric about the vertical axis through the engagement point, the electromagnet is preferably a single solenoid arranged below the engagement point and concentric about the vertical axis through the engagement point, such as a circular solenoid.

It is also within the scope of the present invention that the flame element comprises a single magnet or three magnets. A person skilled in the art will understand how to arrange the electromagnet/magnet(s) in order for the applied force to initiate a combined swinging/rotational movement of the flame element. In order to minimize the power consumption, the mutual positioning of the electromagnet and the magnet (s) is preferably adapted so that the direction of the electromagnetic force applied to the magnet(s) is in a horizontal plane.

The housing may be a single enclosure, where its outer surface then is the outer surface of the electric candle. In this case, the housing is preferably arranged so that its outer surface looks like, and preferably also feels like, the outer surface of a real wax candle, such as by adhering an appropriate sheet/film to the outer surface of the housing.

It is however preferred that the housing comprises an inner housing and an outer housing, where the outer housing is made of stearin or paraffin wax in order to aid in the perception of a real wax candle. As stearin/paraffin wax are relative soft and fragile materials, the inner housing is adapted to support the outer housing in manner that increases the structural stability of the outer housing. The inner housing is preferably made of an appropriate plastic material.

The outer housing is preferably provided with an opening through which the inner housing can be inserted into the outer housing. The inner housing and the outer housing can be arranged so that it is the bottom of the inner housing that closes off the opening of the outer housing, or the electric candle may comprise an appropriate cover piece for closing off the opening. In any case, the opening of the outer housing is preferably provided at the bottom of the outer housing so it is not visible when the electric candle stands on a surface.

It is preferred that the support element, flame element, actuator, light source and preferably also the control system are located inside the inner housing. The power source is preferably provided at the outer surface of the outer housing so that a user easily can change the power source when needed. In case the candle is provided with an on/off switch, the switch is preferably located at the outer surface of the housing so that it easily can be operated by a user.

The inner housing and the outer housing are preferably assembled by mounting the support element, flame element, actuator and light source inside the inner housing; inserting the inner housing into the outer housing through an appropriate bottom opening in the outer housing; and if the bottom of the inner housing does not close off the bottom opening of the outer housing then providing an appropriate cover piece to close off the bottom opening.

The inner housing and outer housing are preferably attached to each other by means of an appropriate adhesive, where the adhesive is provided at the areas where inner housing and the outer housing are in contact when assembled.

The wax of a standard wax candle, especially the part of the wax closest to the flame, is illuminated by the light from the flame. The wax often surrounds a lower part of the flame. A person standing next to the candle will be able to see this illumination, especially if the wax has a light color, which means that this illumination contributes to the user's visual perception of the wax candle. The illumination is not constant due to the flickering of the flame.

The same or similar contribution to the visual perception of the electric candle of the present invention can be obtained by forming the housing, or at least an appropriate part thereof, of a partly transparent material that allows some of the emitted light to pass through the material of the housing, so that some of the emitted light that hits the inner surface of the housing illuminates the outer surface of the housing.

The lower portion of the flame element is preferably formed by at least two separate legs, where one permanent magnet may be located at the lower end of each leg.

In order to reduce the manufacturing costs, the entire flame element can be a flat member, where the lower portion may be formed by two separate legs, in which case one permanent magnet preferably is adhered (e.g. by gluing) to the lower end of each leg, where the magnet can be orientated so that the longitudinal axis through each magnet is perpendicular to the vertical plane through the flat flame element.

When the electric candle comprises a flame element with at least two separate legs and a housing made of a partly transparent material, the legs create a number of distinct shadows on the inner surface of the housing that are visible from outside the housing and moves around due to the rotational/swinging movements of the flame element, and thereby enhances the simulation of a wax candle with a moving burning flame, as the illumination of the housing of the present invention is not constant. The material of the at least two separate legs may be impervious to light or partly transparent.

The wax of a wax candle with a burning flame can also be so that the illumination of the wax is not noticeable by a person located next to the candle, such as if the wax is of a dark color. In order to simulate such a non-noticeable illumination of the housing of the present invention, a light impermeable film/sheet can be provided between the inner housing and the outer housing, where the sheet preferably extends over the entire outer surface of the inner housing.

The electric candle may comprise a mounting base attached to the housing and located inside the housing, where the base is formed with a number of fixation means adapted to allow the support element, actuator and light source to be fixed to the base. The mounting base provides stability to the electric candle, facilitates assembly of the electric candle and ensures that the mutual positioning of the support element, actuator and light source is as intended.

In a preferred embodiment where the actuator comprises at least one magnet attached to the flame element and an electromagnet, the mounting base can be fixed directly to the control system in the form of a printed circuit board (PCB) that controls the electromagnet and the light source, which has the advantage that the electric wirings from the PCB to the electromagnet and light source can be conducted substantially along the surface of the PCB and the surface of the base without hanging through free air, so that the wirings (typically thin copper wires) are protected from unintentionally getting damaged. If the wirings were hanging through free air, it is more likely that they would snap or get detached during e.g. transport of the electric candle.

The mounting base may be fixed to the upper side of a PCB that is orientated horizontally in a position of use of the candle, where the PCB is fixed to the housing. In this way the housing supports the PCB, which supports the mounting base, which supports the support element, electromagnet and light source, which greatly improved that constructional stability of the electric candle.

The support element may be an integral part of the mounting base in order to further facilitate the assembly of the candle and to further enhance the constructional stability of the candle.

The support element can be fixed to the housing at one or more fixation points below the flame element, in which case the support element may comprise one or more longitudinal support members (such as one or more longitudinal support rods) extending from the upper support tip towards the one or more fixation points. In a preferred embodiment, there is only a single longitudinal support rod extending vertically downwards from the upper support tip towards the one or more fixation points.

Alternatively, the support element can be fixed to the housing at one or more fixation points next to the flame element, preferably next to or substantially next to the engagement point between the support tip and the engagement recess, in which case the support element may comprises one or more support members extending horizontally or substantial horizontal between the one or more fixation points and the support tip. An advantage of such a support element is that physical contact between the support element and the lower part/parts of the flame element is avoided during the rotating/swinging movements of the flame element and during transport of the electric candle from the factory where it is subjected to bumps, being turned upside down or similar movements.

It is preferred that the distance between the one or more fixation points and the engagement point is small so that construction tolerances or variations during the fixation of the support element have less impact on the position of the support tip in relation to the housing. By fixing the support element next to the flame element, or next to or substantially next to the engagement point, it is possible to obtain such a preferred small distance.

It is desirable that the upper opening of the housing is as small as possible in order to give the user an impression of a closed housing while allowing the light from the light source inside the housing to pass through the upper opening toward the upper flame portion. It is also desirable that the flame element of the present invention is prevented from falling out of the upper opening by accident, such as if the candle is turned upside down.

Thus, the upper opening of the housing may advantageously be a substantially elongated opening with a substantially circular part, where the vertical axis through the engagement point passes through the center of the circular part so that the flame element is concentric with and embraced by the circular part of the upper opening, and where the upper opening from the circular part extends in the direction towards the light source in order to allow the light beam to project onto the upper flame portion. The circular part of the opening is preferably shaped so that its edge, when the electric candle is assembled, embraces the flame element in a manner where the distance between the flame element and the edge of the central part is small enough to prevent the flame element from accidentally leaving its intended position on top of the support tip, and at the same time large enough to allow the flame element to swing and rotate in relation to the support element without the flame element contacts the edge of the upper opening.

An upper opening with such a shape is particular advantageous when the upper flame portion is a substantially flat member with a maximum width that is larger than the diameter of the circular part of the upper opening but shorter than the longitudinal length of the upper opening, as this allows the assembly of the candle to comprise that the flat upper flame portion is passed through the upper opening while extending in the longitudinal direction of the elongated upper opening, and when the upper flame portion has passed the upper opening, the flame element or the housing is rotated substantially 90° about the vertical axis through the engagement point between the support element and the flame element until the flat surface of the upper flame portion faces toward the light source.

For the embodiments of the present invention where the support tip comprises a substantially flat first portion with a U-shaped cut-out and the flame element comprises a substantially flat second portion with a U-shaped cut-out, each of the diverging sides of the U-shaped cut-out of the support tip may be provided with a horizontally extending projection and the flame element may be provided with a through-going hole, where said projections and said hole are arranged so that each of said projections extends partly into said hole without contacting the flame element in the resting position of the flame element.

Said through-going hole may be replaced with two appropriate cavities, where said projections and said cavities are arranged so that each projection extends partly into one of said cavities without contacting the flame element in the resting position of the flame element.

In an even more preferred embodiment, there is also no contact between said projections and the flame element during use of the electric candle when it is placed horizontally such as on a flat horizontal surface.

The purpose of said projections and said hole (or cavities) is to restrict the vertical movement of the flame element in relation to the support element in order to prevent the flame element from accidentally leaving its intended position on top of the support tip during e.g. transport from the factory.

Said projections are preferably flexible to such an extent that they bend when sufficient force is applied and afterwards return to the horizontal orientation, which means that the flame element and the support element can be locked together during assembly of the electric candle by pressing them together with sufficient force.

Three embodiments of the present invention are shown according to the figures and are described with certain shapes and dimensions, but other shapes and dimensions of the inner housing, outer housing, support element, flame element, magnets, electromagnet, PCB, light source and mounting base are within the scope of the present invention.

FIG. 1 shows a first embodiment of an electric candle 1 according to the present invention with an outer housing 2 and an inner housing 3, where it mainly is the outer housing 2 (e.g. made of paraffin wax) that is visible. The inner housing has an upper opening 5 surrounded by an upright rim 93. The outer housing 2 has an upper opening 4 into which the rim 93 of the inner housing 3 fits so that the upper edge of the opening 4 and the upper edge of the rim 93 substantially are level. The flame element 6 has an upper flame portion 7 that extends through the upper opening 5 of the inner housing 3 and the upper opening 4 of the outer housing 2.

The upper flame portion 7 is substantially flat although provided with a concave portion 8 and convex portion 9. The outline of the upper flame portion 7 has the same form as a real burning flame of a wax candle. However, other shapes of the upper flame portion is naturally also possible, such as e.g. a completely flat version of the shown concave/convex version.

The upper edge 10 of the outer housing 2 is uneven in order to resemble the corresponding upper edge of a wax candle that has been lid for some time. The openings 4,5 of the housings 2,3 are arranged and the LED 11 inside inner housing 3 is arranged so that the light from the LED 11 hits the side 12 of the upper flame portion 7 that faces the part of the outer housing 2 where its upper edge 10 is lowered to almost be at level with the upper opening 4 of the outer housing 2. The purpose of having this part of the edge 10 being lowered is to increase the amount of light being dispersed from the upper flame portion 7 to the surroundings.

Figure 2:
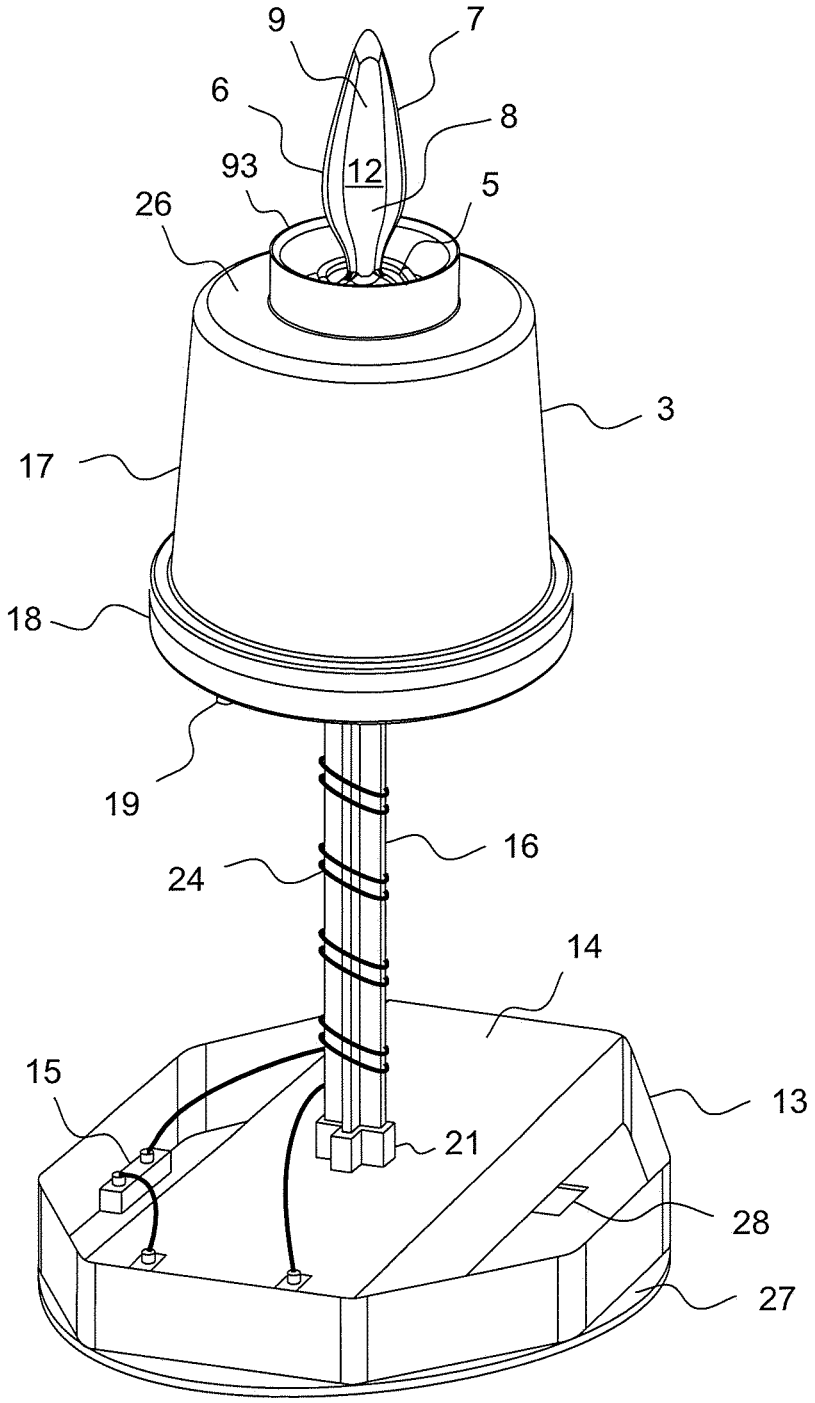
FIG. 2 shows the embodiment of FIG. 1 and without the outer housing.

FIG. 2 shows the cover piece 13 that closes off the lower opening (not shown) of the outer housing 2, where the cover piece 13 is formed by a battery compartment 14 with a switch 15 for turning the candle on/off.

The inner housing 3 comprises a main body 17 with a lower opening (not shown) and a cover 18 for closing the lower opening, where three tabs 19 (only one is visible in FIG. 2) of the main body 17 extend through three through-going tab slots 20 (shown in FIG. 5) of the lid 18, where the tabs 19 and tab slots 20 ensure that the main body 17 and the lid 18 are orientated as intended. The main body 17 and the cover 18 are connected to the battery compartment 14 by means of a support rod 16.

The cover 18 can be fixed to the main body 17 by gluing, or by melting the tabs 19 to the lid 18 once assembled. The lower end of the rod 16 is inserted into a square fixation slot 21 on the battery compartment 14 and the upper end of the rod 16 is inserted in a corresponding square fixation slot 22 (se FIG. 3) on the cover 18. The cover 18 is provided with a wiring opening 23 (shown in FIG. 6) that allows the wirings 24 from the battery and the switch 15 to be connected to a printed circuit board (PCB) 25 located inside the inner housing 3.

The inner housing 3 is provided with an upper circumferential flange 26 and the cover piece 13 is also provided with a circumferential flange 27, where each of the flanges 26,27 engages with and are fixed to corresponding engagement flanges (not shown) of the outer housing 2. This fixation can be obtained by provided the flanges 26,27 with glue before the outer housing 2 is assembled with the inner housing 3 and the cover piece 13.

The user operates the assembled candle 1 from the cover piece 13, from where the user has access to the switch 15 and a battery lid (not shown). The battery lid is provided with a tab (not shown) that locks with a tab slot 28 on the cover piece 13.

Figure 3:
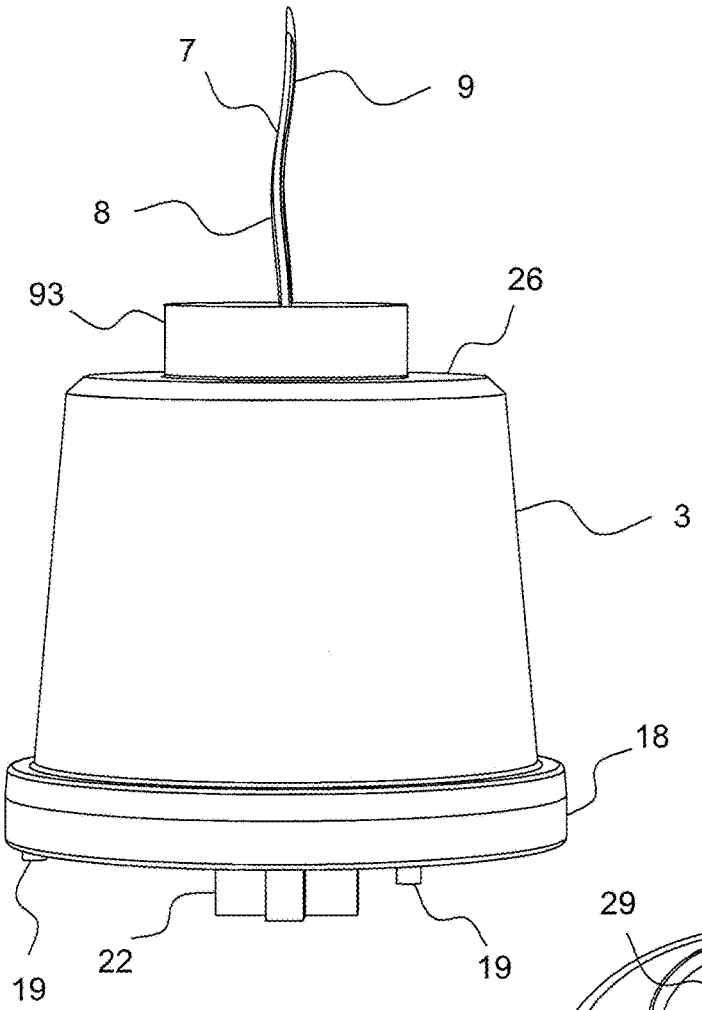
FIGS. 3 and 4 shows the inner housing of the embodiment of FIG. 1.

The concave portion 8 and convex portion 9 of the upper flame portion 7 are especially clearly shown in FIG. 3.

Figure 4:
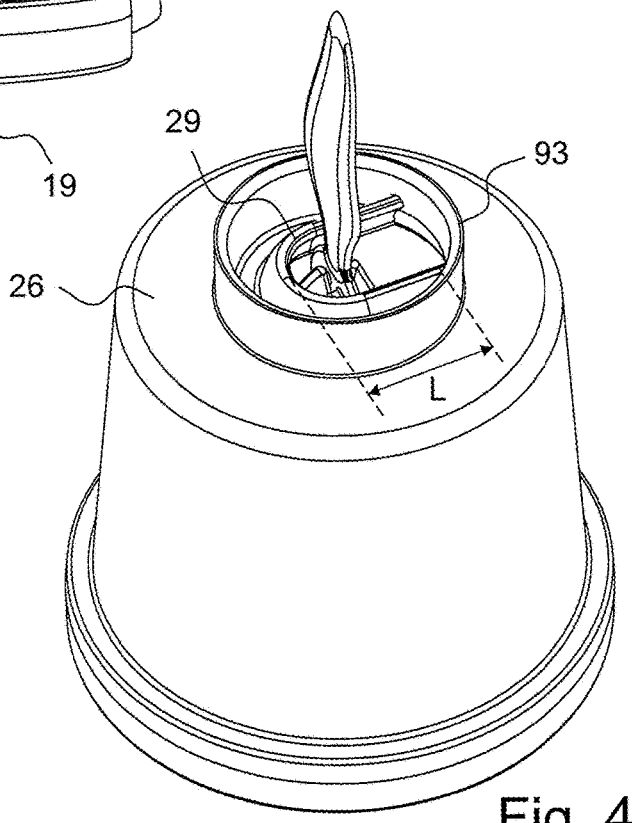

FIG. 4 shows that the upper opening 5 of the inner housing 3 has an oblong shape with the length L and a substantially circular part 29 above the support element 6. The upper opening 5 extends from the central part 29 in the direction towards the LED 11 in order to allow the light beam from the LED 11 to project onto the upper flame portion 7.

The central part 29 of the upper opening 5 is formed so that the distance between the edge of the flat middle portion 47 (the term "flat middle portion" corresponds to the flat second portion of the flame element) and the edge of this central part 29 is large enough to allow the flame element 6 to swing and rotate within the intended extent without touching the inner housing 3 and at the same time so small that the flame element is restricted to be located in the center of the inner housing 3, i.e. below the central part 29 of the upper opening 5.

The flame element 6 is restricted to being located under this central part 29, as removal therefrom would require that the diverging sides 59,60 of the cut-out 48 of the flat middle portion 47 was elevated above the diverging sides 57,58 of the cut-out 46 of the flat support tip 45, but an elevation of the flame element 6 to such an extent is not possible because the extent of elevation is restricted by the distance between the upper edge of the flat middle portion 47 and the edge of the upper opening 5. In other words, the flat middle portion 47 would hit the edge of the central part 29 before such an extent of elevation is reached.

Thus, the flame element 6 is prevented from accidentally falling out of the inner housing 3 or from leaving its intended position on top of the support element 40.

Figure 5:
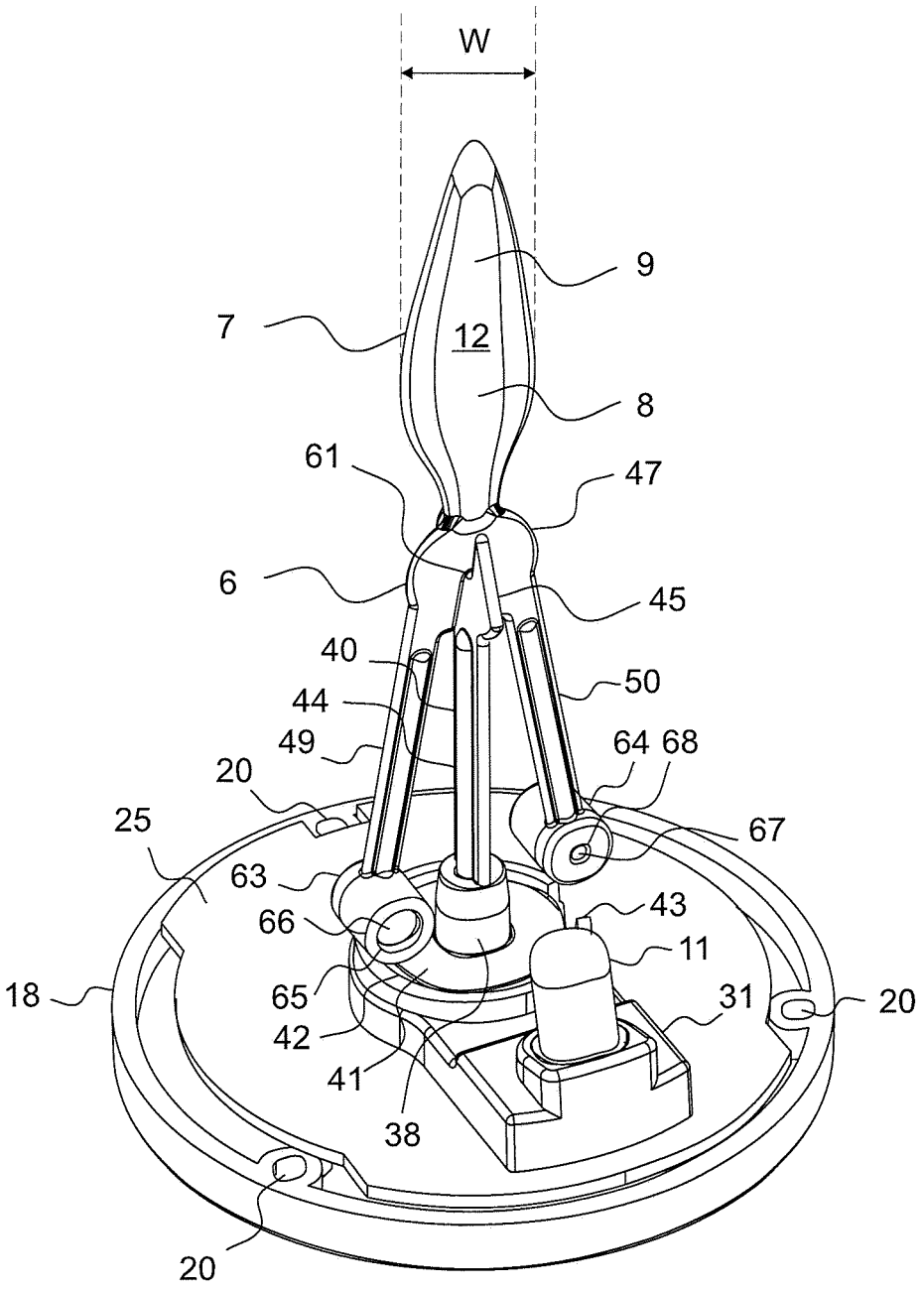
FIG. 5 shows the components inside the inner housing of the embodiment of FIG. 1.
Figure 6:
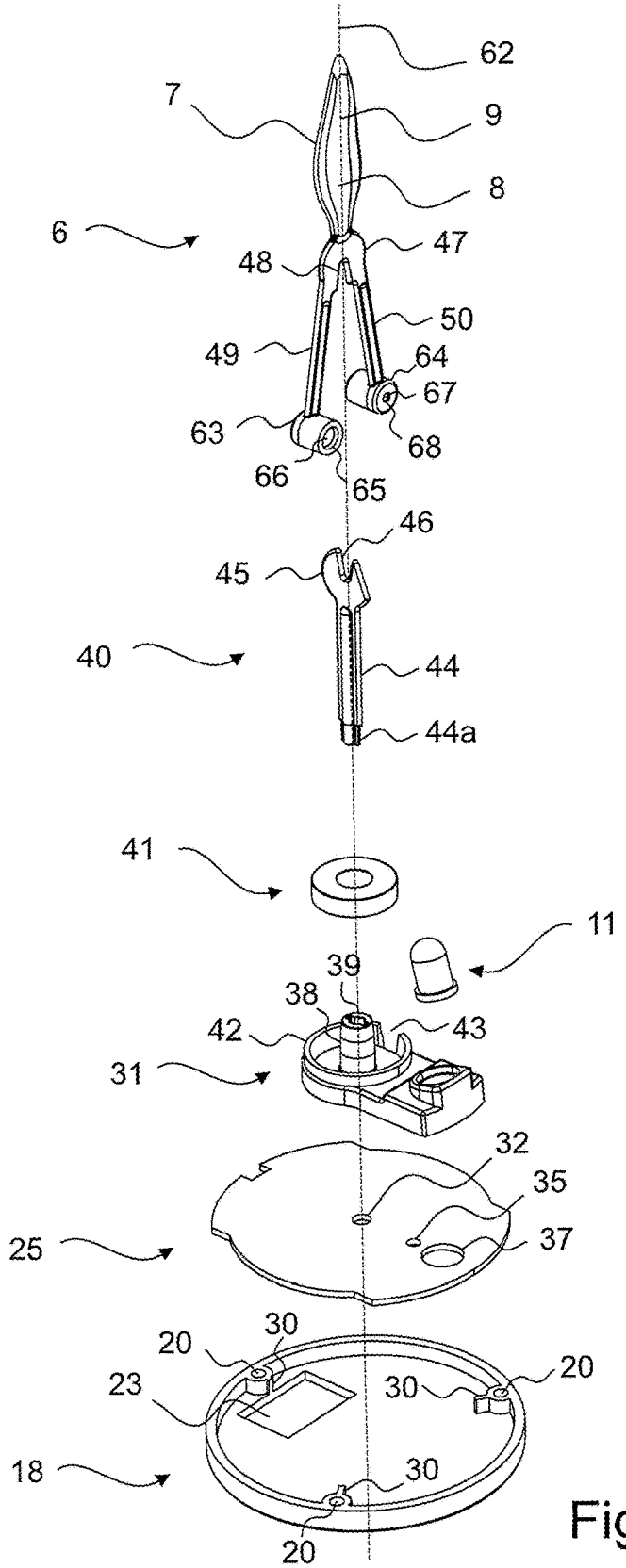
FIG. 6 is an exploded with of FIG. 5, FIGS. 7 and 8 show the mounting base of the embodiment of FIG. 1 seen from above and below, respectively.

FIGS. 5 and 6 show that the cover 18 has three tab slots 20 from which three support tabs 30 extend, and that the circumferential edge of the PCB 25 rests on and is fixed (e.g. by gluing) to these support tabs 30 so that there is a gap (not shown) between the main part of the PCB 25 and the cover 18. The gap makes room for the electric components (not shown) on the downwards facing side of the PCB 25, i.e. the side that faces towards the cover 18. The side of the PCB 25 that faces upwards is shown blank for illustrative purposes.

Figure 7:
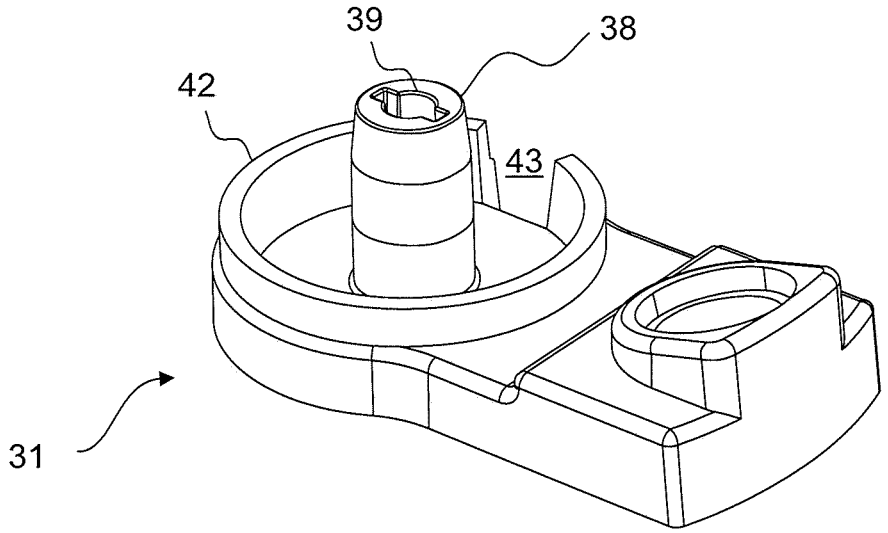
Figure 8:
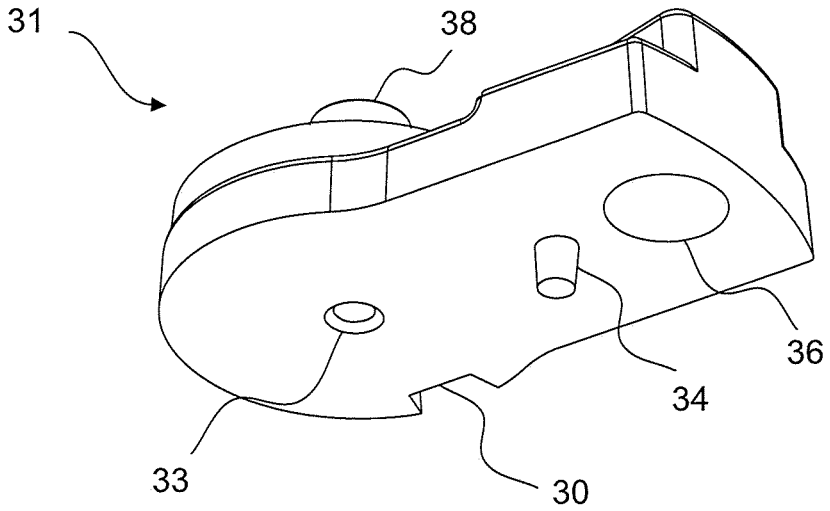

The mounting base 31 shown in details in FIGS. 7 and 8 is attached to the PCB 25 by means of a screw (not shown) extending through a screw opening 32 in the PCB 25 and a corresponding screw opening 33 in the base 31. The base 31 has a tab 34 that is inserted into a corresponding tab slot 35 in the PCB 25, which together with the screw ensure that the PCB 25 and base 31 are aligned as intended.

The legs (not shown) of the LED 11 are wired to the downwards facing side of the PCB 25 via the opening 36 in the base 31 and the corresponding opening 37 in the PCB 25. The legs could also be wired directly on the upwards facing side of the PCB 25 by means of through-hole soldering, in which case the opening 37 is not needed.

The mounting base 31 comprises a vertical holder 38 with a slot 39 for receiving the support element 40. The support element 40 is preferably fixed to the mounting base 31 by means of gluing. An electromagnetic coil 41 is located between the holder 38 and a circular rim 42 of the base 31, and is attached (e.g. by gluing) to the base 31. The rim 42 has a slot 43 through which the ends of the coil 41 extend down to and are soldered to the upwards facing side of the PCB 25.

Figure 11:
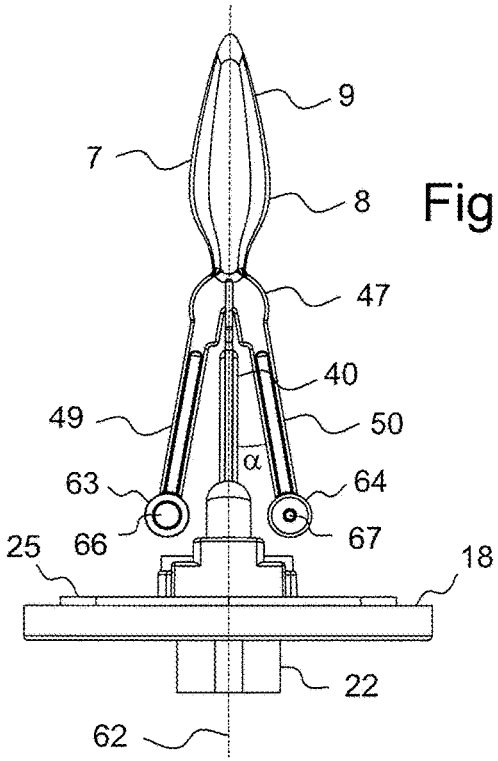

The support element 40 has a straight leg 44 with a bottom part 44*a*, where the shape of the bottom part 44*a* matches the shape of the slot 39 of the mounting base 31 so that the support element 40 is aligned correctly with the mounting base 31. The support element 40 has a flat support tip 45 with an upwards facing U-shaped cut-out 46. The upper flame portion 7 of the flame element 6 extends into a flat middle portion 47 with a downwards facing U-shaped cut-out 48, and the flat middle portion 47 extends into two legs 49,50 diverging away from the center of the flame element 6 with an inclined angle $\alpha$ (as indicated in FIG. 11).

Figure 9:
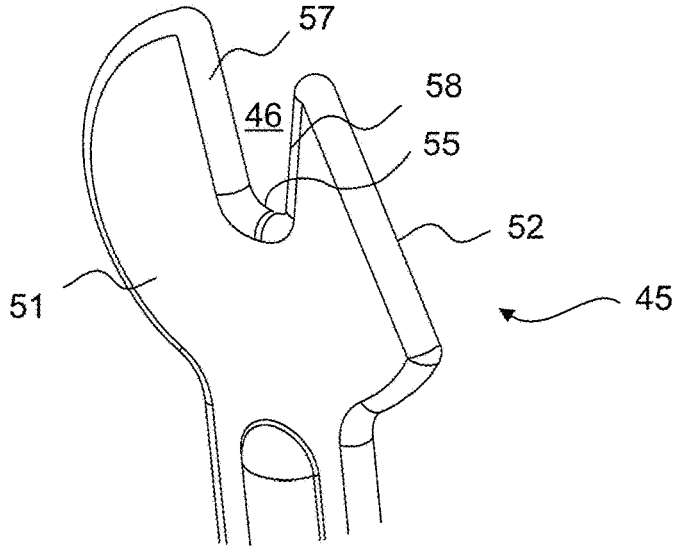
FIG. 9 shows the support tip of the support element of the embodiment of FIG. 1.
Figure 10:
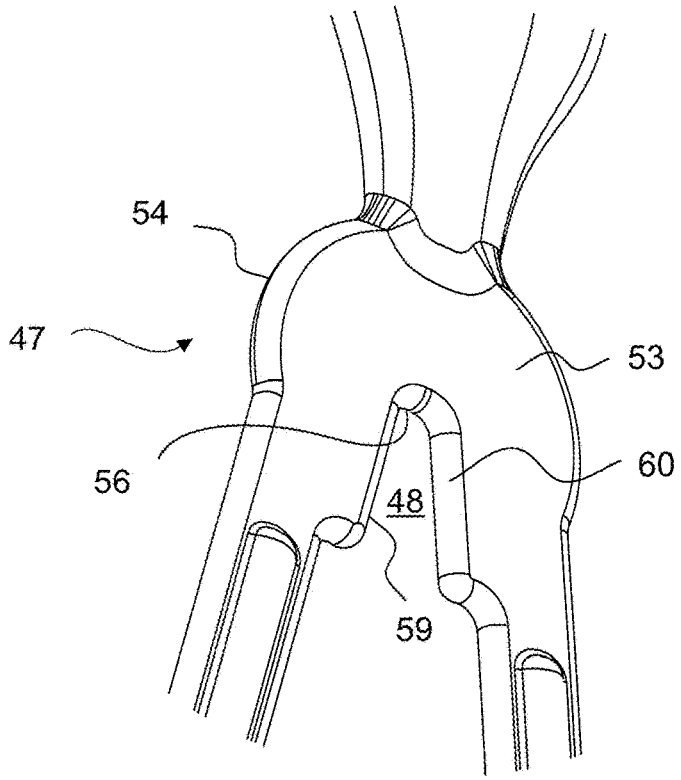
FIG. 10 shows the middle portion of the flame element of the embodiment of FIG. 1, FIGS. 11, 12 and 13 are a front view, side view and top view, respectively, of the same as in FIG. 5.

FIG. 9 is a close-up view of the flat support tip 45, which essentially is a flat element with a first surface 51, a second surface 52 opposite the first surface 51, and provided with a U-shaped cut-out 46. FIG. 10 is a close-up view of the flat middle portion 47 of the flame element 6, where the flat middle portion 47 essentially is a flat element with a first surface 53, a second surface 54 opposite the first surface 53, and provided with a U-shaped cut-out 48.

Each of the cut-outs 46,48 has a bottom 55,56 and two diverging straight sides 57,58,59,60 that meet at the bottom 55,56, where the inclination angle between the vertical axis 62,62',62" and each diverging side 57,58,59,60 is the same.

Each cut-out 46,48 is rounded in the transverse direction, i.e. in the direction from the first surface 51,53 to the second surface 52,54, which provides a smooth transition between the first surface 51,53 and the second surface 52,54 for each of the cut-outs 46,48. As the bottom 55,56 of each cut-out 46,48 is rounded, when seen in the plane of the flat element, a smooth transition between the two diverging sides 57,58, 59,60 is provided. These smooth transitions of each cut-out 46,48 reduce the friction between the support tip 45 and the flame element 6 when the flame element 6 swings and rotates during use of the candle 1.

Figure 13:
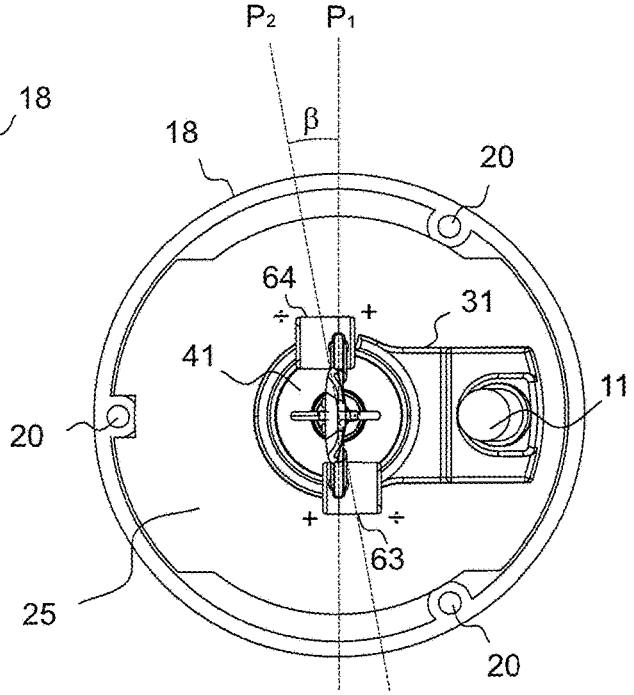
Figure 12:
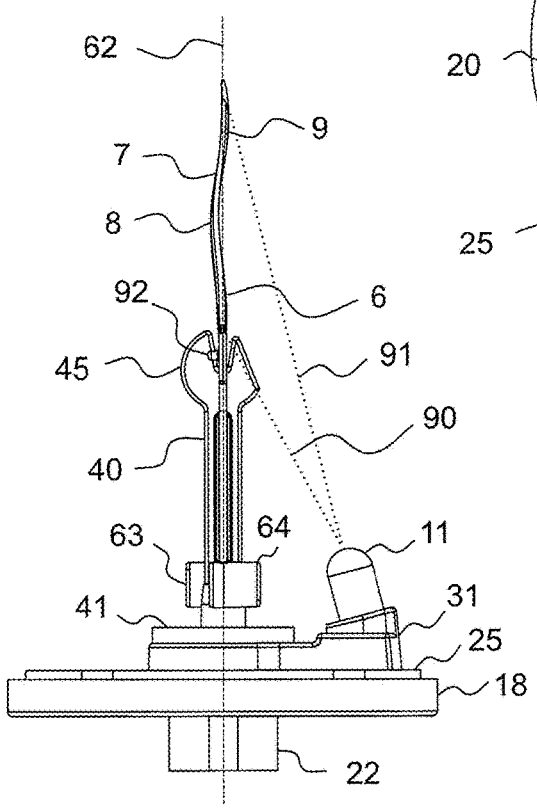

FIGS. 11-13 show the flame element 6 in its resting position where it rests on top of the support element 40 and where the angle between the flat support tip 45 and the flat middle portion 47 is 90°. In this resting position, the point where the bottoms 55,56 of the two cut-outs 46,48 contact each other is the engagement point 61. The holder 38 and the coil 41 are concentric with the vertical axis 62 through the engagement point 61.

The lower end of each of the legs 49,50 has a cylindrically shaped holder 63,64 that is hollow with a large opening 65 at one end for easy inserting of a permanent magnet 66,67 into the holder during production of the candle 1. The opposite end of each holder 63,64 has a small opening 68 that can be used for subsequently pushing the magnet 66,67 out of the holder 63,64 if needed.

The legs 49,50 of the flame element 6 are substantially flat, but could also have other another shape such as cylindrical.

As best seen in FIG. 13, the center of each of the magnets 66,67 does not lie in the same vertical plane $P_1$ as the vertical plane of the flat middle portion 47 of the flame element 6, as the holders 63,64 are displaced in opposite horizontal directions in relation to the plane $P_1$. The vertical plane through the vertical axis 62 and the center of each of the two magnets 66,67 defines a second vertical plane $P_2$, which is non-parallel with the vertical plane $P_2$ of the flat middle portion 47. The angle $\theta$ between the two planes $P_1$ and $P_2$ is shown in FIG. 13.

The vertical distance between the PCB 25 and each of the magnets 66,67 are the same, the horizontal distance between the vertical axis 62 and each of the magnets 66,67 are also the same, and the electromagnet 41 is concentric with the vertical axis 62.

When the flame element 6 rotates angularly away from its resting position, i.e. rotates either clockwise or counter-clockwise about the vertical axis 62, the flame element 6 will be elevated vertically in relation to the stationary support element 40, as the diverging sides 59,60 of the cut-out 48 of the flame element 6 will slide on the diverging sides 57,58 of the cut-out 46 of the support tip 45.

The vertical plane $P_1$ of the flat middle portion 47 in the resting position of the flame element 6 is the vertical plane in which back and forth swinging movement of the flame element 6 is associated with less friction, as it is only the bottoms 55,56 of the cut-outs 46,48 that are in contact.

The polarity of each of the two magnets 66,67 is indicated by the signs + and ÷ in FIG. 13. The magnets 66,67 are displaced in opposite horizontal directions compared to the vertical plane $P_1$, and the north pole of the magnets are closer to the center of the electromagnet coil 41 than the south pole of the magnets. Thus, when the flame element 6 is in its resting position and the electromagnet is activated, the flame element 6 will, depending on the direction of the current through the coil 41, rotate in the direction from the first vertical plane $P_1$ toward the second vertical plane $P_2$ or in the direction from the second vertical plane $P_2$ towards the first vertical plane $P_1$. Naturally, the magnets 66,67 could just as well be oriented opposite in the holders 63,63 so that the south pole of each magnet 66,67 is closer to the center of the coil 41 than the north pole.

The flame element 6 is preferably manufactured using injection moulding where the two moulding half forms are parallel to the vertical plane $P_1$ of the flat middle portion 47. It is thus preferred that the holders 63,64 are orientated so that the longitudinal axis through the holders are perpendicular to the plane $P_1$ of the flat middle portion 47, so that the flame element 6 is easy to mould using injection moulding. The holders 63,64 could also be orientated so that the longitudinal axis through the holders were parallel with the plane of the flame element, but in this case the injection moulding would become more complex, as a core would have to be projected into the cavity between the two moulding halves in a direction that is perpendicular with the direction of draw.

The embodiment of the flame element 6 shown in FIGS. 1-13 could be modified by changing the orientation of the holders so that the longitudinal axis through each of the holders (and thus through each of the magnets) is not a horizontal axis (as in the embodiment of FIGS. 1-13) but e.g. a vertical axis or a tilted axis that is parallel with the longitudinal axis of the leg 49,50, i.e. it is maintained that the vertical plane through the vertical axis 62 and the center of each of the two magnets defines a second vertical plane $P_2$ that is non-parallel with the first vertical plane $P_1$ of the flat middle portion 47 of the flame element 6, when the flame element is in its resting position.

The inner housing 3 of the first embodiment is preferably assembled by:

attaching the cover 18, PCB 25, mounting base 31, electromagnetic coil 41, support element 40 and light source 11 together, lowering the flame element 6 with the magnets 66,67 down onto the support tip 45 into its resting position, bringing the main body 17 and the cover 18 toward each other in a direction parallel with the vertical axis 62 but with the flame element 6 centered in the upper opening 5 and while the main body 17 and the cover 18 are orientated so that the flat upper flame portion 7 extends in the longitudinal direction of the upper opening 5 (i.e. while the main body is rotated about 90° compared to its orientation shown in FIGS. 1-4) and until the upper flame portion 7 extends out of the upper opening 5 of the main body 17 but before the tabs 19 enters into the tab slots 20, rotating the main body 17 or the cover 18 substantially 90° about the vertical axis 62 until the flat upper flame portion 7 extends in the transverse direction of the upper opening 5, moving the main body 17 and/or the cover 18 until the flame element 6 is centered in the central part 29 of the upper opening 5, bringing the main body 17 and the cover 18 further together along the vertical axis 62 into their assembled positions where the tabs 19 have entered into the tab slots 20, and fixing the main body 17 and the cover 18 to each other by e.g. gluing or heat melting.

The length L of the upper opening 5' is longer than the maximum width W (see FIG. 5) of the flame element 6.

Figure 14:
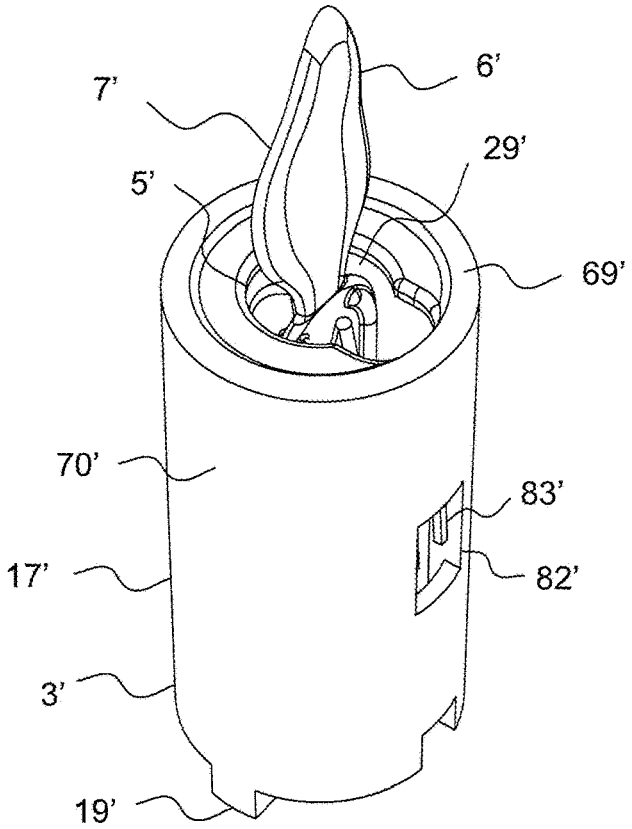
FIG. 14 shows the inner housing of a second embodiment of the present invention.

FIG. 14 shows the inner housing 3' of a second embodiment of the electric candle where the inner housing 3' has a substantially cylindrical shape and is more compact compared to the inner housing 3 of the first embodiment.

The upper opening 5' has a slight different shape than the corresponding opening 5 of the first embodiment, but in the assembled state of the electric candle the opening 5' serves the same purposes. The upper opening 5' of the inner housing 3' has a substantially circular part 29' that opens up in the direction of the LED 11'. The upper opening 5' is shaped and dimensioned so that emitted light from the LED 11' can pass through the upper opening 5' and hit the upper flame portion 7' of the flame element 6', the flame element 6' is able to swing/rotate within the intended extent without touching the inner housing 3', and the flame element 6' is restricted to being located under the circular part 29'.

The inner housing 3' comprises a main body 17' with a lower opening (not shown) that is attached directly to and covered by a PCB (not shown). The main body 17' has two tabs 19' that extend into corresponding tab slots in the PCB to ensure correct orientation of the PCB in relation to the inner housing 3'. The PCB can be fixed to the main body 17' by means of gluing.

The second embodiment has a cover piece (not shown) similar to the cover piece 13 of the first embodiment, i.e. comprising a battery compartment, a switch for turning the candle on/off, and a square fixation slot. A support rod (not shown) with the same shape and function as in the first embodiment is inserted into a square fixation slot on the cover piece and a corresponding square fixation slot on the lower side of the PCB.

The main body 17' and the cover piece are fixed to an outer housing (not shown) that can be made of paraffin wax, where the outer housing has an upper opening that is formed so that the circumferential upper edge 69' of the inner housing 3' is at level with the circumferential upper edge of upper opening of the outer housing, and so that the upper flame portion 7' extends out of the upper opening of the outer housing.

The outer housing is fixed to the cover piece in the same way as in the first embodiment, i.e. by means of a circumferential engagement flange on the cover piece and a corresponding flange on the outer housing. The outer housing is formed so that it engages with and is fixed, e.g. by gluing, to an appropriate part of the outer vertical surface 70' of the inner housing 3'.

Figure 15:
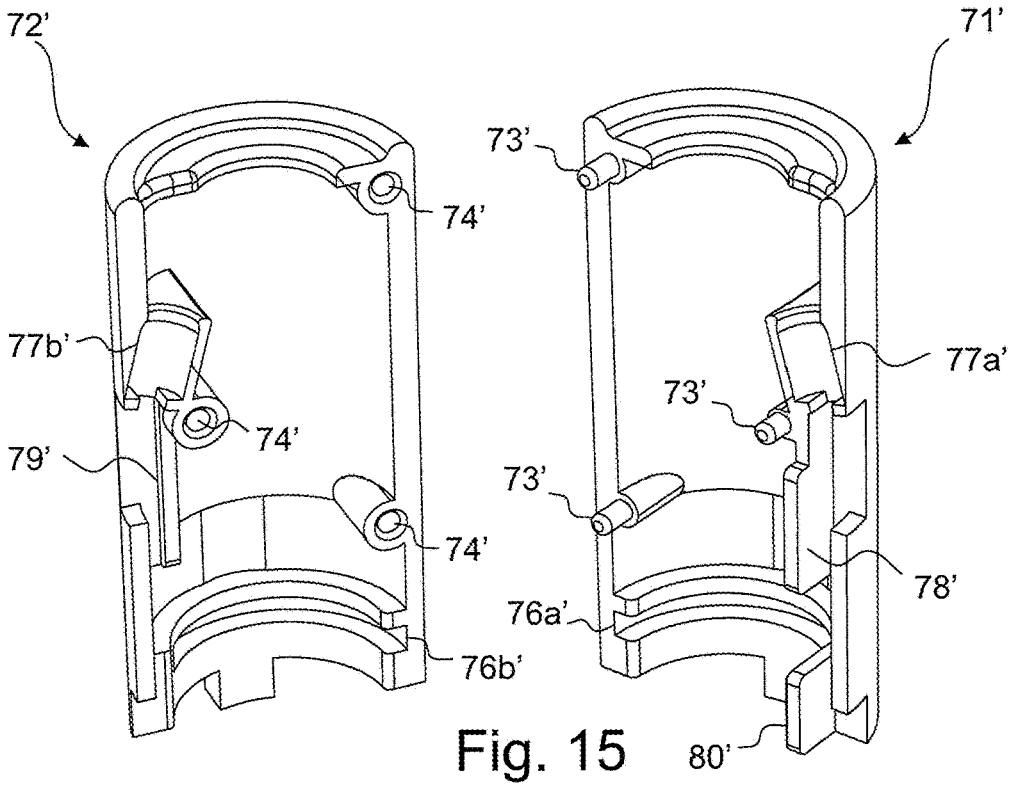
FIG. 15 shows a disassembled state of the two half pieces of the inner housing shown in FIG. 14.

FIG. 15 shows that the inner housing 3' comprises a first half piece 71' and a second half piece 72' that when assembled are fixed to each other e.g. by gluing. To ensure correct mutual alignment of the two half pieces 71',72', the first half piece 71' has three tabs 73' that are inserted into three corresponding tab slots 74' of the second half piece 72'.

Figure 16:
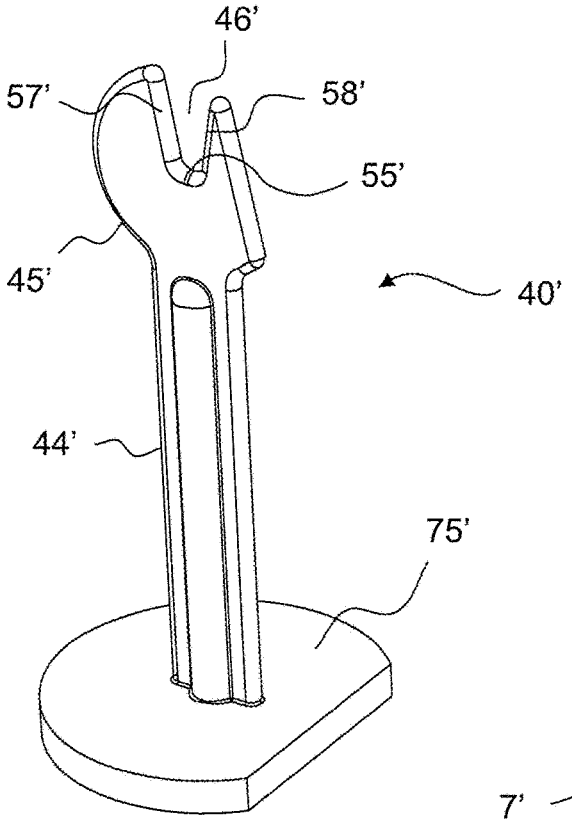
FIG. 16 shows the support element of the embodiment of FIG. 14.

FIG. 16 shows that the support element 40' has a flat support tip 45', a straight leg 44' and a horizontal bottom plate 75'. When assembled, the guide channels halves 76*a*', 76*b*' of the two half pieces 71',72' forms a guide channel in which the bottom plate 75' is located, and thereby supported.

Figure 17:
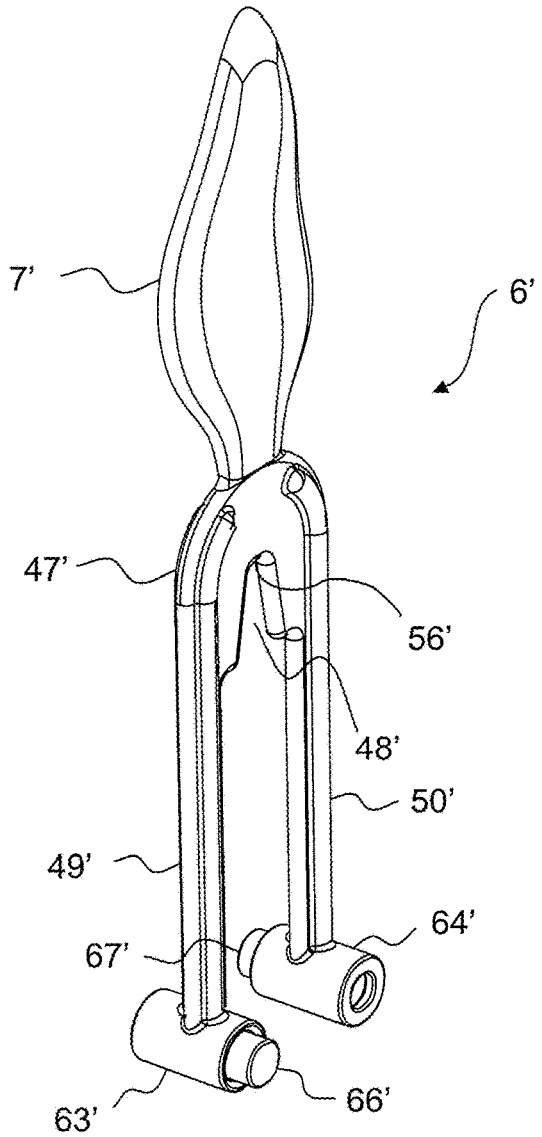
FIG. 17 shows the flame element of the embodiment of FIG. 14.

FIG. 17 show that the flame element 6' has an upper flame portion 7', a flat middle portion 47' and two legs 49',50'.

The upper flame portion 7' of the flame element 6', as well as the flat support tip 45' of the support element 40', have the same form as the corresponding parts 7,45 of the first embodiment, and need thus not to be described further.

The flame element 6' differs from the flame element 6 of the first embodiment in that the legs 49',50' extend vertically downwards so that the flame element 6' fits inside the inner housing 3' that is more compact compared to the inner housing 3 of the first embodiment.

Figure 18:
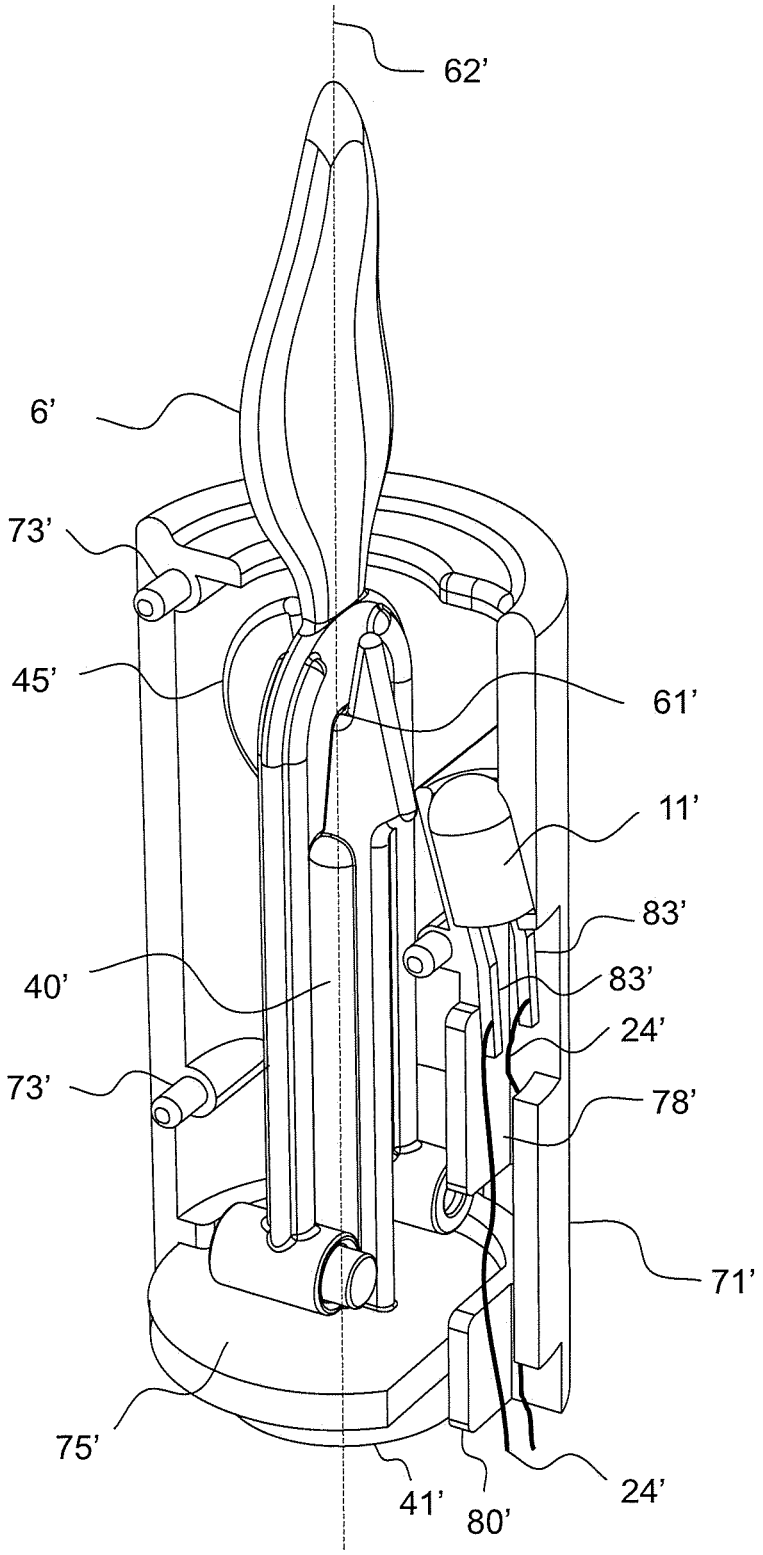
FIG. 18 shows the same as in FIG. 14 but without one of the half pieces of the inner housing.

FIGS. 14 and 18 show the flame element 6' in its resting position on the support element 40' where the angle between the flat support tip 45' and the flat middle portion 47' is 90°, and where the point of contact between the bottoms 55',56' of the two U-shaped cut-outs 46',48' define the engagement point 61', just as with the first embodiment.

FIG. 18 show the support element 40', flame element 6' and LED 11' at their intended positions in relation to the first half piece 71'.

The center of each of the holders 63',64' and also the center of each of the magnets 66',67' does not lie in the same vertical plane as the vertical plane of the flat middle portion 47' of the flame element 6'. The holders 63',64' are displaced in opposite horizontal directions in relation to the vertical plane of the flat middle portion 47'.

The vertical plane through the engagement axis 62' and the center of the two magnets 66',67' defines a second vertical plane, which is non-parallel with the vertical plane of the flat middle portion 47', just as with the first embodiment although with a different angle between the two planes.

The circular electromagnetic coil 41' is fixed to the upper side of the not shown PCB, and the coil 41' is concentric with the vertical axis 62' through the engagement point 61'. The coil 41' is shown in FIG. 18 in order to illustrate its position in relation to the magnets 66',67' and the engagement point 61'.

When assembled, the seat halves 77*a*',77*b*' of the half pieces 71',72' form a seat for the LED 11'. The protection plates 78',79',80' allows the wirings 24' from the LED 11' to be guided between these plates 78',79',80' and the inner surface of the two half pieces 71',72' and down towards the PCB in a manner where the wirings 24' are separated from the moving flame element 6', so that the wirings 24' are protected from getting damaged. When assembled, the half pieces 71',72' form an opening 81' that allows the wirings 24' from the LED 11' to passed down to the PCB, and the plate 79' and plate 80' are arranged to be in contact or almost in contact with each other.

The wirings (not shown) from the PCB to the battery and the switch are preferably twisted around the rod in the manner as the corresponding wirings 24 for the first embodiment as shown in FIG. 2.

When assembled, the half pieces 71',72' form an opening 82' in the inner housing 3' to make room for the soldering material (not shown) at the point where the legs 83' of the LED 11' are soldered to the wirings 24'.

The bottom plate 75' has a non-circular shape which together with the plate 80' of the first half piece 71' ensures that the bottom plate 75' is orientated correctly in the guide channel formed by the guide channel halves 76*a*',76*b*', which thereby ensures that the mutual positioning of the support element 40' and the inner housing 3' is as intended.

The inner housing 3' of the second embodiment is preferably assembled by:

- positioning the LED 11' in the seat half 77*a*' of the first half piece 71', and optionally fixing the LED 11' to the seat half 77*a*' by e.g. gluing,
- soldering the wirings 24' to the legs 83' of the LED 11' and guiding the wirings 24' down between the plates 78',80' and the inner surface of the half piece 71',
- lowering the flame element 6' with the magnets 66',67' down onto the support tip 45' into its resting position,
- shifting the bottom plate 75' of the support element 40' into the guide channel half 76*a*' of the first half piece 71',
- bringing the two half pieces 71',72' together using the tabs 73' and the tab slots 74' to ensure correct alignment, and
- fixing the two half pieces 71'72' together using appropriate fixation means.

Figure 19:
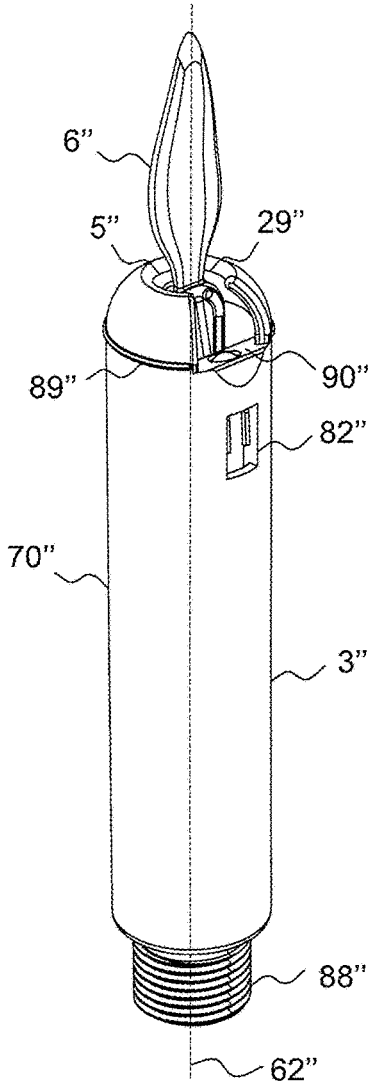
FIG. 19 shows a third embodiment of the present invention.
Figure 20:
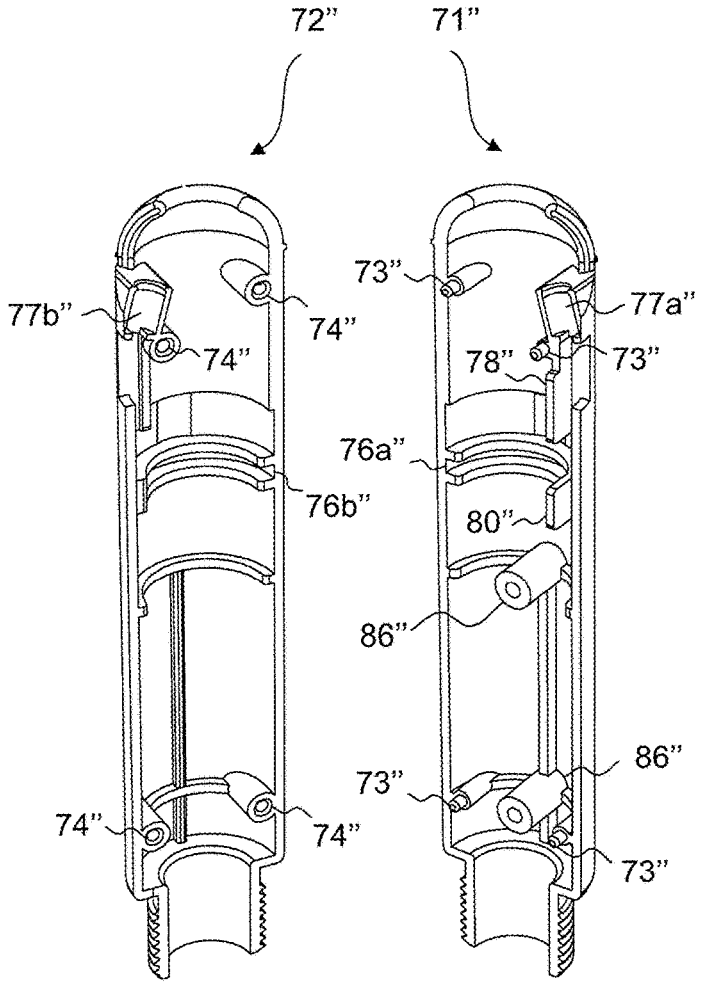
FIG. 20 shows a disassembled state of the two half pieces of the inner housing shown in FIG. 19.
Figure 21:
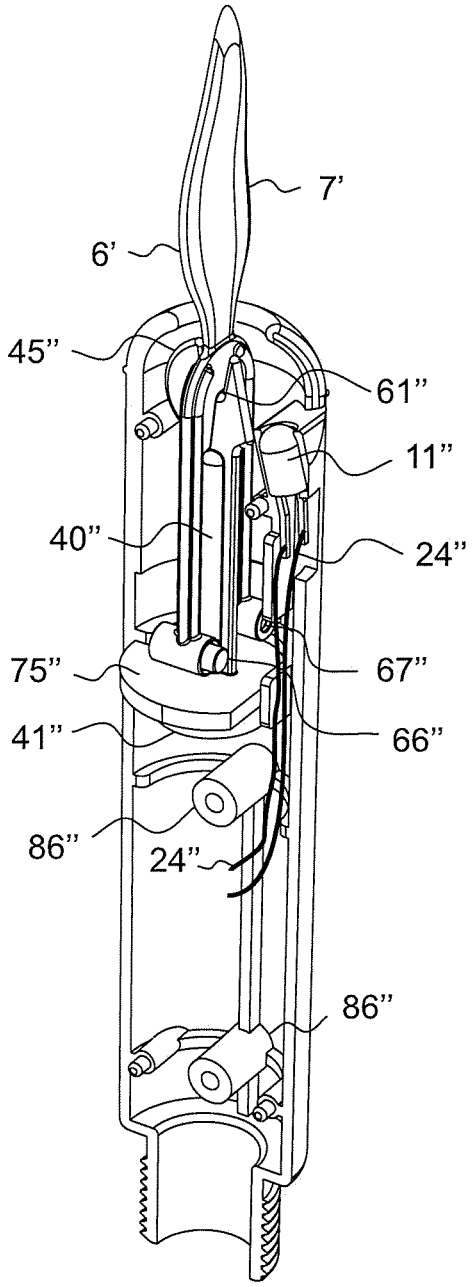
FIG. 21 shows the same as in FIG. 19 but without one of the half pieces of the inner housing.

FIGS. 19-21 shown a third embodiment of the present invention, where the support element 40", flame element 6", electromagnetic coil 41" and the LED 11" are the same as in the second embodiment, and where the inner housing 3" is formed by two half pieces 71",72" that are very similar to the corresponding half pieces 71',72' of the second embodiment.

Just as with the second embodiment, the half pieces 71",72" have guide channel halves 76*a*",76*b*" that together form a guide channel for the bottom plate 75", and they have seat halves 77*a*",77*b*" that together form a seat for the LED 11". Just as with the second embodiment, the half pieces 71",72" form an opening 82" in the inner housing 3" to make room for soldering material. The first half piece 71*a*" has four tabs 73" for being inserted into four corresponding tab slots 74" on the second half piece 72*h*".

In the assembled state of the candle, the upper opening 5" of the inner housing 3" is shaped differently than the corresponding openings 5,5' of the first and second embodiments, but serves the same purposes, as the substantially circular part 29" allows the flame element 6" to swing/rotate within the intended extent without touching the inner housing 3", and at the same time prevents the flame element 6" from accidentally falling out of the inner housing 3", such as if the candle is turned upside down. The upper opening 5" extends from the circular part 29" in the direction towards the LED 11".

The inner housing 3" of the second embodiment is higher than the inner housing 3' of the second embodiment, as the third embodiment is intended for an electric candle that looks like a crown candle, where the second embodiment (and the first embodiment) are intended for candles that look like block candles.

The first half piece 71" has two mounting slots 86" for mounting a PCB (not shown) at the lower half of the inner housing 3", where the PCB is orientated vertically. The electromagnetic coil 41" is attached, e.g. by gluing, to the bottom surface of the bottom plate 75" of the support element 40".

The inner housing 3" is connected to a cover piece (not shown) by means of a hollow rod (not shown) with screw threads at both ends. The inner housing 3" has screw threads 88" for attachment to the upper end of the rod. The cover piece is also arranged with screw threads for attachment to the lower end of the rod.

Just as with the first and second embodiment, the cover piece of the third embodiment comprise a battery compart for batteries and a switch for turning the candle on/off. The wirings (not shown) from the PCB to the battery compartment and switch are conducted inside the rod. The wirings from the PCB to the electromagnet 41" are not shown. The wirings 24" between the LED 11" and the PCB are guided between the protection plates 78",80" and the inner surface of the half pieces 71",72" for protection just as with the second embodiment. The inner housing 3" could be connected to the cover piece by other means than a hollow rod.

The inner housing 3" and the cover piece are fixed to an outer housing (not shown) that preferably is made of paraffin wax and is shaped as a hollow cylinder with an upper opening and a lower opening. The lower opening of the outer housing is closed off by the cover piece in a similar way as with the first and second embodiment. The outer housing is arranged so that its upper opening extends up to the lower edge of the rim 89" extending around the inner housing 3".

The outer housing is formed and arranged so that appropriate parts of its inner surface engages with and are fixed to appropriate parts of the outer surface 70" of the inner housing 3" and appropriate surface parts of the cover piece.

The lower edge of the rim 89" is located slightly higher (about 1-3 mm) than the upper edge of the LED 11" and the surface 90" from which the LED 11" extends is tilted slightly towards the flame element, which means that the LED 11" itself is only visible to a person that looks down onto the candle.

FIGS. 22-25 show a fourth embodiment of the present invention where the inner housing comprises two half pieces 171,172, where the flame element 106 is the same as the flame element 6 of the first embodiment except that the flat middle portion 147 is provided with a through-going hole 194, and where the support element 140 is fixed to the inner housing at two fixation points at the same vertical level as the middle portion 147 of the flame element 106.

The support element 140 has a flat support tip 145 with an upwards facing U-shaped cut-out 146 that has the same shape as the U-shaped cut-out 46 of the support element 40 of the first embodiment, except that each of the diverging sides 157,158 of the cut-out 146 is provided with a horizontally extending projection **195*a*,195*b* arranged so that the free distance between the projections 195*a*,195*b* are shorter than the thickness of the of the middle portion 147 of the flame element 106 so that the projections 195*a*,195*b* extend partly into the through-going hole 194 of the flame element 106** when the electric candle is assembled.

Figure 24:
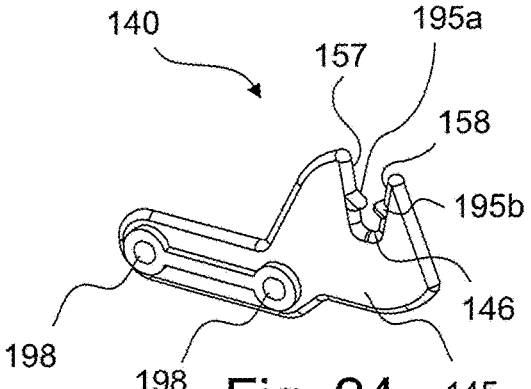
FIG. 24 shows the support element of the embodiment of FIG. 22.

The projections **195*a*,195*b* are preferably flexible to such an extent that they bend when sufficient force is applied and afterwards return to the horizontal orientation e.g. shown in FIG. 24, which means that the flame element 106 and the support element 140 can be locked together during assembly of the electric candle by pressing them together with an appropriate force. The projections 195*a*,195*b* restrict the vertical movement of the flame element 106 in relation to the support element 140 and thereby locks the flame element 106 and the support element 140** together.

Figure 22:
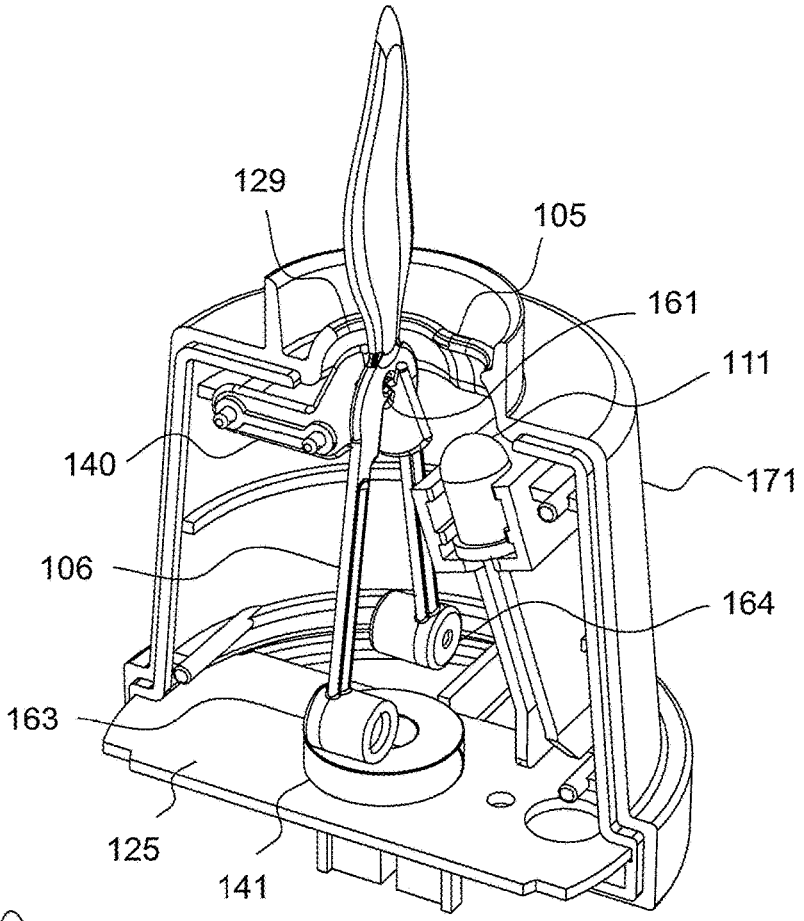
FIG. 22 shows a fourth embodiment of the present invention without one of the half pieces of the inner housing and without the outer housing.
Figure 23:
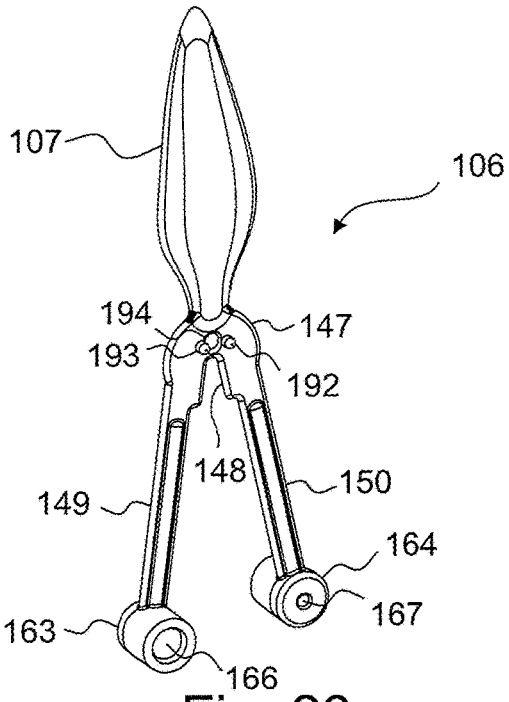
FIG. 23 shows the flame element of embodiment of FIG. 22.
Figure 25:
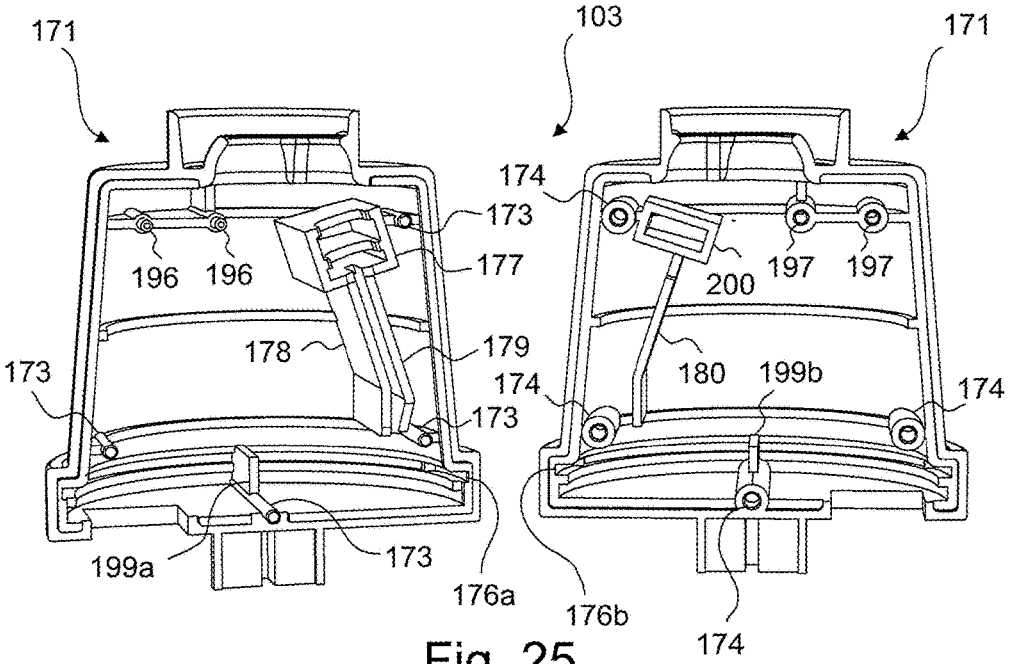
FIG. 25 shows a disassembled state of the two half pieces of the inner housing of the embodiment of FIG. 22.

FIG. 25 shows that the first half piece 171 has six tabs 173,196 that are inserted into six corresponding tab slots 174,197 of the second half piece 172 to ensure mutual alignment of the two half pieces. The support element 140 is provided with two through-going holes 198 into which the two tabs 196 of the half piece 171 fits, and the support element 140 is fixed to the inner housing 103 by sliding it over the two tab 196 (as shown in FIG. 22) before the two half pieces 171,172 are assembled. The upper flame portion 107 extends out of the substantially circular part 129 of the upper opening 105 of the inner housing 103.

The two half pieces 171,172 can be fixed to each other by press-fitting the tabs 173,196 and the tab slots 174,197 together and/or by gluing the half pieces together. When assembled, the two guide channel halves **176*a*,176*b* of the half pieces 171,172 forms a guide channel for supporting a printed circuit board (PCB) 125 onto which an electromagnetic coil 141 is attached. This guide channel together with the two lock projections 199*a*,199*b* ensure that the PCB 125 maintain its intended position, and thus also ensures that the coil 141 maintain its intended position directly below the engagement point 161**.

The first half piece 171 has a seat 177 for supporting the LED 111 and the space between the two plates 178,179 forms a guide channel for the wirings (not shown) from the LED 111 to the PCB 125 in order to prevent physical contact between the wirings and the moving flame element 106. When the half pieces 178,179 are assembled, the square-shaped projection 200 of the second half piece 172 abuts the seat 177 (or the LED 111) in order to lock the LED 111 into place, and the plate 180 of the second half piece 172 closes off the guide channel formed by the two plates 178,179 so that the wirings are kept inside the guide channel.

Figure 28:
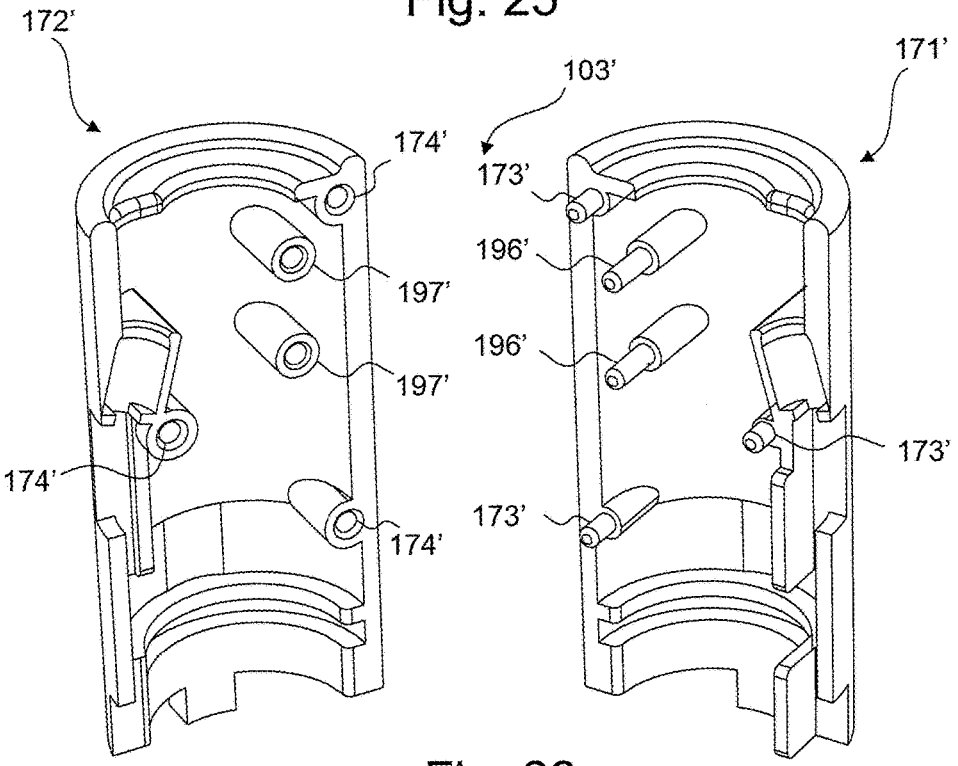
FIG. 28 shows a disassembled state of the two half pieces of the inner housing of the fifth embodiment.
Figure 26:
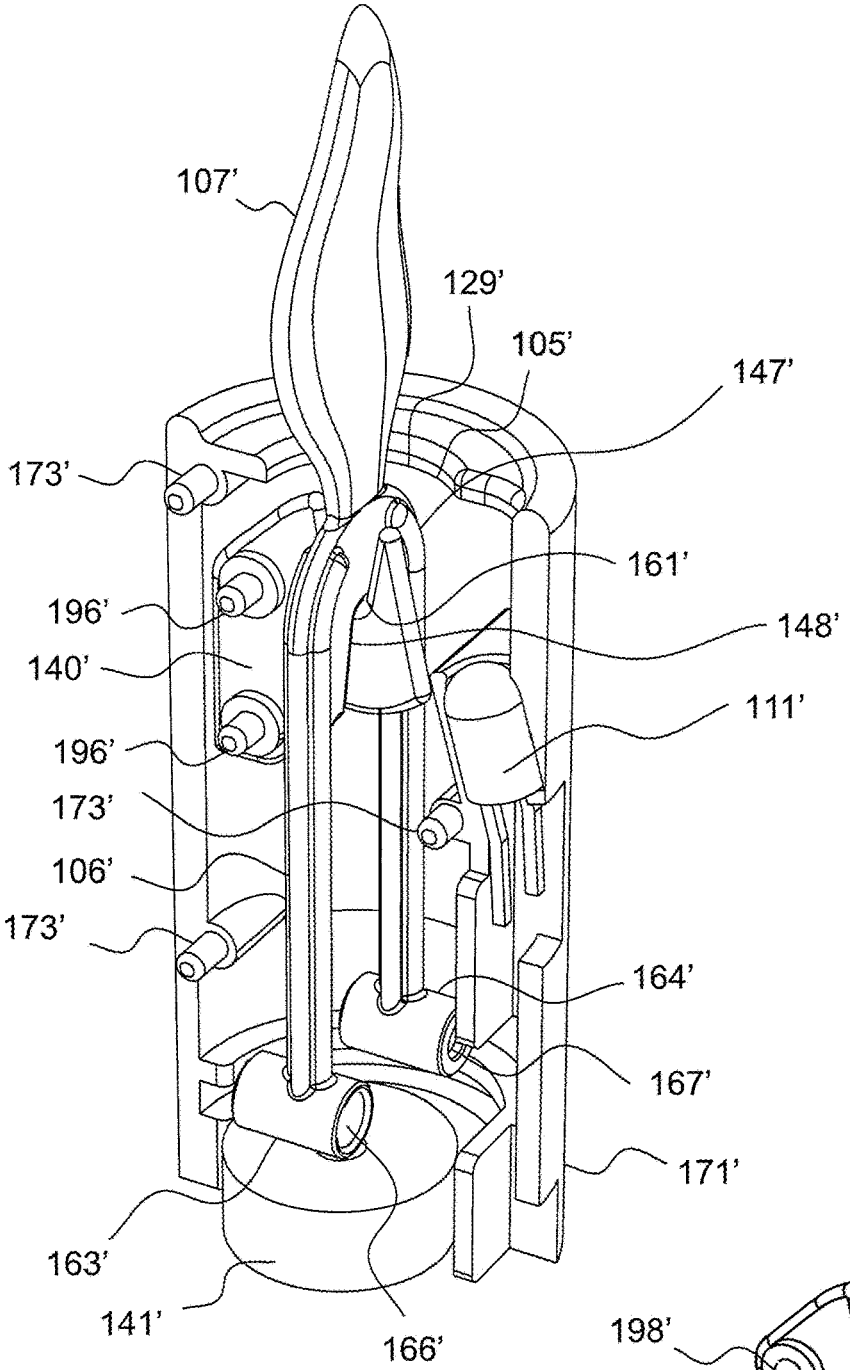
FIG. 26 shows a fifth embodiment of the present invention without one of the half pieces of the inner housing.
Figure 27:
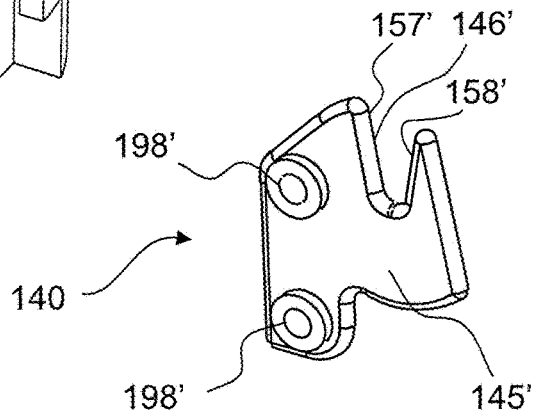
FIG. 27 shows the support element of the fifth embodiment.

FIGS. 26-28 show a fifth embodiment of the present invention that is the same as the second embodiment shown in FIGS. 14-18, except that the support element 140' has a different shape and is attached to the inner housing 103' at two fixation points next to the middle portion 147' of the flame element 106'.

The support element 140' has two through-going holes 198' into which the two tabs 196' of the first half piece 171' fits, and just as with the fourth embodiment shown in FIGS. 22-25, the support element 140' is fixed to the inner housing by sliding it over the two tabs 196' before the two half pieces are assembled. FIG. 28 show the five tabs 173',196' of the first half piece 171' that are inserted into five corresponding tab slots 174',197' of the second half piece 172'.

The fifth embodiment has a LED 111' and an electromagnetic coil 141'; the support element 140' has a support tip 145' with a flat first portion with an U-shaped cut-out 146'; the flame element 106' has an upper flame portion 107', a flat middle portion 147' with a U-shaped cut-out 148', two magnets 166',167'; and the upper opening 105' of the inner housing 103' has a substantially circular part 129'.

Figure 29:
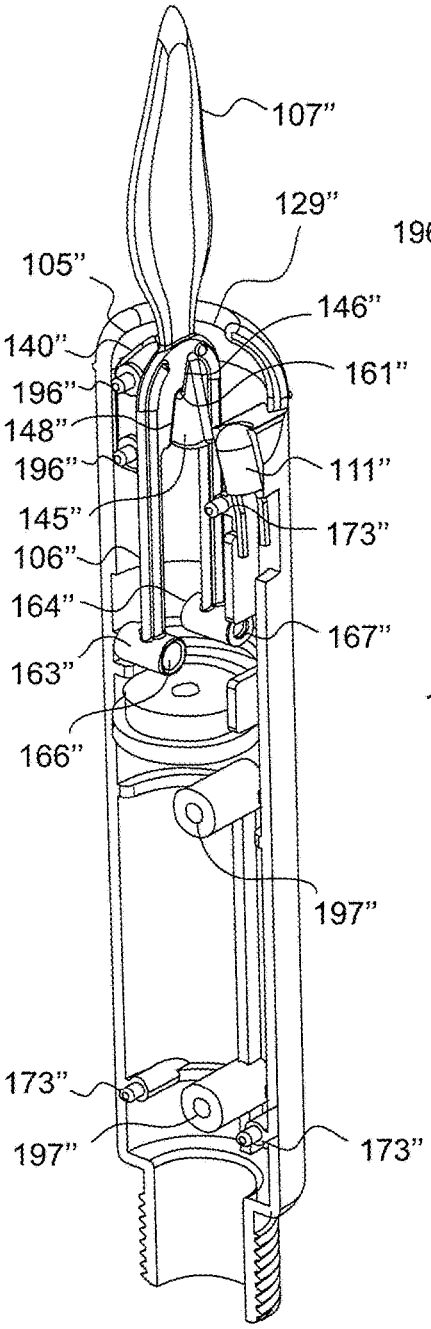
FIG. 29 shows a sixth embodiment of the present invention without one of the half pieces of the inner housing.

FIGS. 29 an 30 show a sixth embodiment of the present invention that is the same as the third embodiment shown in FIGS. 19-21, except that the support element 140" has a different shape and is attached to the inner housing 103" at two fixation points next to the middle portion 147" of the flame element 106". The flame element 106" of the sixth embodiment has the same shape as the flame element 106' of the fifth embodiment.

Figure 30:
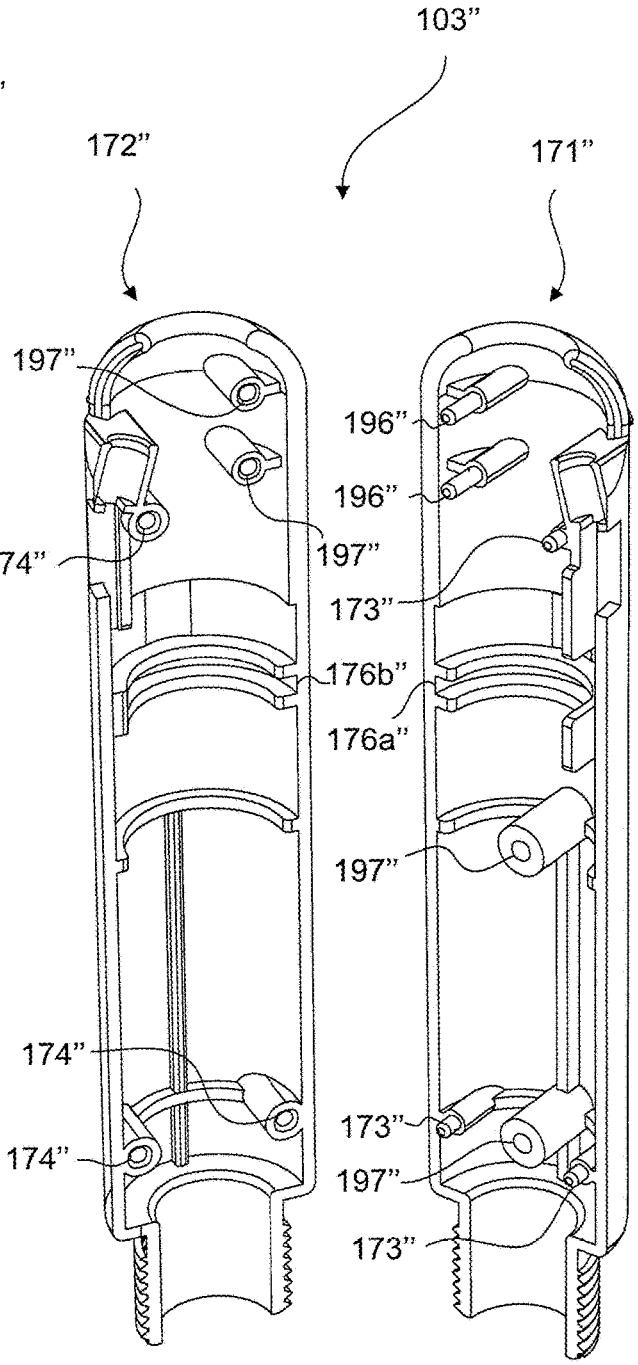
FIG. 30 shows a disassembled state of the two half pieces of the inner housing of the sixth embodiment.

The support element 140" has two through-going holes 198" into which the two tabs 196" of the first half piece 171" fits, and just as with the fifth embodiment, the support element 140" is fixed to the inner housing by sliding it over the two tabs 196" before the two half pieces are assembled. FIG. 30 show the six tabs 173",196" of the first half piece 171" that are inserted into six corresponding tab slots 174",197" of the second half piece 172".

Just as the third embodiment, the sixth embodiment has a LED 111" and an electromagnetic coil 141"; the support element 140" has a support tip 145" with a flat first portion with an U-shaped cut-out 146"; the flame element 106" has an upper flame portion 107", a flat middle portion 147" with a U-shaped cut-out 148", two magnets 166",167", an upper opening 105" of the inner housing has a substantially circular part 129".

In the fourth, fifth and sixth embodiments the electromagnetic coil 141;141';141" is concentric with the vertical axis through the engagement point 161;161';161"; and the two magnets 166,167;166',167';166",167" are arranged inside the holders 163,164;163',164';163",164" so that the vertical plane through the center of both magnets and the engagement point defines a second vertical plane $P_2$ that is non-parallel with the first vertical plane $P_1$ of the flat second portion 147;147';147" of the flame element 106;106';106" in its resting position.

In the fourth and fifth embodiment, the inner housing is made of an appropriate plastic material and supports an outer housing made of stearin or paraffin wax. In the sixth embodiment, the housing is a single enclosure, i.e. the housing comprises only the inner housing where its outer surface is the outer surface of the electric candle, and an appropriate sheet/film can be adhered to the outer surface of the housing.

For each of the first, second, third, fourth, fifth and sixth embodiment, the LED 11,11',11",111,111',111" and the flat support tip 45,45',45",145,145',145'" are arranged so that the light is projected onto the upper flame portion 7,7',7",107, 107',107" in a manner as indicated for the first embodiment by the light beam boundaries 90,91 shown in FIG. 12, i.e. where the light hits the upper flame portion 7,7',7",107,107', 107" from its top to its bottom, and where a small oblong shadow is produced at the very bottom of the upper flame portion 7,7',7",107,107',107" because an appropriate part of the flat support tip 45,45',45",145,145',145'" comes between the emitted light and the upper flame portion 7,7',7",107, 107',107". The small oblong shadow looks like the dark wick of a real burning flame in order to enhance the simulation of a real burning flame.

The flame element 6;106 of the first and fourth embodiment is provided with two horizontally extending projections 92;192 (one of them is visible for the first embodiment in FIG. 12), which extend from the surface of the flat middle portion 47;147 that faces away from the LED 11;111 and are provided symmetric about the vertical axis 62 through the engagement point 61;161. The projections 92;192 restrict the angular rotation of the flame element 6;106 about the vertical axis 62 as they would hit the surface of the flat support tip 45;145 if the flame element 6;106 is rotated beyond a certain threshold. The flame element 6';6";106'; 106" of the second, third, fifth and sixth embodiment does not have such projections to restrict their angular rotation. It is within the scope of the present invention that the flame elements 6;6';6";106;106';106" of any the first, second, third, fourth, fifth and sixth embodiments have or does not have such projections 92;192.

The various features of the different embodiments can be combined to provide further features of the invention, and that the described/claimed invention is not limited in scope by the illustrative embodiments of the figures, and that equivalent embodiments are intended to be within the scope of this invention.

What is claimed is:

1. An electric candle comprising:

a housing with an upper opening, a support element with a support tip, a flame element comprising an upper flame portion extending out of said upper opening and an engagement recess for receiving said support tip in a manner wherein the flame element rests on top of the support element and the contact point between the support tip and the engagement recess defines an engagement point, an actuator for applying a force to the flame element, and a light source for emitting light on the upper flame portion, wherein the support tip, the engagement recess and the actuator are configured so that said force causes the flame element to simultaneously swing about said engagement point and rotate about the vertical axis through said engagement point, wherein the support element and the engagement recess are configured so that the flame element has a resting position with a specific position and specific orientation in relation to the support element, wherein the support tip comprises a substantially flat first portion that is orientated vertically and has a substantially U-shaped cut-out facing upwards, and wherein the flame element comprises a substantially flat second portion that is orientated vertically and has a substantially U-shaped cut-out facing downwards, wherein said cut-out defines the engagement recess of the flame element.

2. An electric candle according to claim 1, wherein the support tip and the engagement recess are configured so that the flame element ascend in relation to the support tip when said rotational movement of the flame element is in a direction from said resting position towards a first position, and descend when said rotational movement is in a direction from said first position towards said resting position.

3. An electric candle according to claim 1, wherein the diverging sides and the bottom of each cut-out are rounded in the transverse direction.

4. An electric candle according to claim 1, wherein the vertical plane of said flat second portion in the resting position of the flame element defines a first vertical plane $P_1$, and the actuator is advantageously configured so that the direction of the force applied by the actuator on the flame element, when the flame element is in its resting position, is in a second vertical plane $P_2$ that is non-parallel with said first vertical plane.

5. An electric candle according to claim 4, wherein the second vertical plane $P_2$ goes through the engagement point.

6. An electric candle according to claim 1, wherein:

the vertical plane of said flat second portion in the resting position of the flame element defines a first vertical plane $P_1$, the actuator comprises at least one magnet fixed to the flame element, and an electromagnetic coil arranged below said at least one magnet and concentric about said vertical axis, the at least one magnet is arranged so that the vertical plane through the center of said magnet and the engagement point is non-parallel with said first vertical plane $P_1$, and each of the at least one magnet is arranged so that its north pole is closer to the center of the electromagnet coil than its south pole, or vice versa.

7. An electric candle according to claim 6, wherein each of the at least one magnet is arranged so that its longitudinal axis is perpendicular to said first vertical plane.

8. An electric candle according to claim 1, wherein the actuator comprises two magnets arranged on the flame element so that they in the resting position of the flame element are located on opposite sides of the flat first portion of the support tip.

9. An electric candle according to claim 1, wherein the angle between the first vertical plane $P_1$ and the second vertical plane $P_2$ is between 5° and 20°, or about 10°.

10. An electric candle according to claim 1, wherein the actuator comprises at least one magnet fixed to the flame element, and an electromagnetic coil arranged below said at least one magnet and concentric about the vertical axis through said engagement point, and wherein the electromagnetic coil is arranged so that the electromagnetic field generated by the electromagnetic coil is symmetric about the vertical axis through the engagement point.

11. An electric candle according to claim 1, wherein the actuator comprises at least one magnet fixed to the flame element and an electromagnetic coil arranged below the flame element.

12. An electric candle according to claim 1, wherein the upper opening of the housing is a substantially elongated opening with a substantially circular part, the vertical axis through the engagement point passes through the center of said circular part so that the flame element is concentric with and embraced by said circular part, said upper opening extends from said circular part in the direction towards the light source in order to allow the light beam to project onto the upper flame portion, said circular part is shaped so that its edge embraces the flame element in a manner wherein the distance between the flame element and the edge of said central part is small enough to prevent the flame element from accidentally leaving its intended position on top of the support tip, and at the same time large enough to allow the flame element to swing and rotate in relation to the support element without the flame element contacts the edge of said upper opening.

13. An electric candle according to claim 1, wherein the housing comprises an outer housing made of stearin or paraffin wax and an inner housing adapted to support the outer housing, and wherein the support element, electromagnet and light source are located inside the inner housing.

14. An electric candle according to claim 1, wherein the housing is at least partly made from a partly transparent material, and the lower portion of the flame element comprises at least two separate legs.

15. An electric candle according to claim 1, wherein the candle comprises a mounting base attached to the housing and located inside the housing, wherein the base is formed with a number of fixation means adapted to allow the support element, electromagnet and light source to be fixed to the base.

16. An electric candle according to claim 1, wherein the upper opening of the housing comprises a substantially circular part that embraces the flame element, the vertical axis through the engagement point passes through the center of said circular part, said upper opening extends from said circular part in the direction towards the light source, and the upper flame portion is a substantially flat member with a maximum width that is larger than the diameter of said circular part but shorter than the longitudinal length L of said upper opening.

17. An electric candle according to claim 1, wherein the support element is fixed to the housing at one or more fixation points next to or substantially next to the engagement point between the support tip and the engagement recess.

18. An electric candle according to claim 1, wherein the upper flame portion is a flat member or a substantially flat member.

19. An electric candle according to claim 1, wherein the angle between the first portion and the second portion is substantially 90° when the flame element is in its resting position.

20. An electric candle comprising:

a housing with an upper opening, a support element with a support tip, wherein the support tip comprises a substantially flat first portion that is orientated vertically and has a substantially U-shaped cut-out facing upwards, a flame element comprising an upper flame portion extending out of said upper opening and a substantially flat second portion that is orientated vertically and has a substantially U-shaped cut-out facing downwards, wherein the U-shaped cut-out of the flame element defines an engagement recess for receiving said support tip in a manner wherein the flame element rests on top of the support element and the contact point between the support tip and the engagement recess defines an engagement point, wherein the support element and the engagement recess are configured so that the flame element has a resting position with a specific position and specific orientation in relation to the support element, an actuator for applying a force to the flame element, and a light source for emitting light on the upper flame portion, wherein the support tip, the engagement recess and the actuator are configured so that said force causes the flame element to simultaneously swing about said engagement point and rotate about the vertical axis through said engagement point, and wherein the angle between the first portion and the second portion is substantially 90° when the flame element is in its resting position.

21. An electric candle according to claim 20, wherein the actuator comprises at least one magnet fixed to the flame element, and an electromagnetic coil arranged below said at least one magnet and concentric about the vertical axis through the engagement point.

22. An electric candle comprising:

a housing with an upper opening, a support element with a support tip comprising a substantially flat first portion that is orientated vertically, a flame element comprising an upper flame portion extending out of said upper opening and a substantially flat second portion that is orientated vertically and has an engagement recess for receiving said support tip in a manner wherein the flame element rests on top of the support element and the contact point between the support tip and the engagement recess defines an engagement point, an actuator for applying a force to the flame element, and a light source for emitting light on the upper flame portion, wherein the support tip, the engagement recess and the actuator are configured so that said force causes the flame element to simultaneously swing about said engagement point and rotate about the vertical axis through said engagement point, wherein the vertical plane of said flat second portion in the resting position of the flame element defines a first vertical plane $P_1$, wherein the actuator comprises two magnets arranged on the flame element so that they in the resting position of the flame element are located on opposite sides of the flat first portion of the support tip and the actuator comprises an electromagnetic coil arranged so that the electromagnetic field generated by the electromagnetic coil is symmetric about the vertical axis through the engagement point, and wherein the vertical plane through the center of both said magnets and the engagement point defines a second vertical plane $P_2$ that is non-parallel with said first vertical plane $P_1$, and wherein the center of both said magnets are in the same horizontal plane and at the same distance from the engagement point.

23. An electric candle comprising:

a housing with an upper opening, a support element with a support tip, a flame element comprising an upper flame portion extending out of said upper opening and an engagement recess for receiving said support tip in a manner wherein the flame element rests on top of the support element and the contact point between the support tip and the engagement recess defines an engagement point, an actuator for applying a force to the flame element, and a light source for emitting light on the upper flame portion, wherein the support element and the engagement recess are configured so that the flame element has a resting position with a specific position and specific orientation in relation to the support element, wherein the support tip comprises a substantially flat first portion that is orientated vertically and has a substantially U-shaped cut-out facing upwards, wherein the flame element comprises a substantially flat second portion that is orientated vertically and has a substantially U-shaped cut-out facing downwards, wherein said cut-out defines the engagement recess of the flame element, wherein the support tip, the engagement recess and the actuator are configured so that said force causes the flame element to simultaneously swing about said engagement point and rotate about the vertical axis through said engagement point, and wherein each of the diverging sides of the U-shaped cut-out of the support tip comprises a horizontally extending projection, and the flame element comprises a through-going hole or two cavities, wherein said projections and said hole/cavities are arranged so that said projections does not contact the flame element during use of the electric candle.

24. An electric candle according to claim 23, wherein the actuator comprises at least one magnet fixed to the flame element, and an electromagnetic coil arranged below said at least one magnet and concentric about the vertical axis through the engagement point.

* * * * *